US012679606B2

(12) United States Patent
Ditore et al.

(10) Patent No.: US 12,679,606 B2
(45) Date of Patent: Jul. 14, 2026

(54) FITMENT ASSEMBLY FOR A FLEXIBLE CONTAINER, FLEXIBLE CONTAINER HAVING A FITMENT ASSEMBLY AND PROBE USED FOR DISPENSING FROM A FLEXIBLE CONTAINER

(71) Applicant: Scholle IPN Corporation, Northlake, IL (US)

(72) Inventors: Steve Ditore, Oswego, IL (US); Brent Haynam, Creve Coeur, MO (US)

(73) Assignee: SCHOLLE IPN CORPORATION, Northlake, IL (US)

( * ) Notice: Subject to any disclaimer, the term of this patent is extended or adjusted under 35 U.S.C. 154(b) by 286 days.

(21) Appl. No.: 18/388,512

(22) Filed: Nov. 9, 2023

(65) Prior Publication Data

US 2024/0158137 A1 May 16, 2024

Related U.S. Application Data

(60) Provisional application No. 63/425,661, filed on Nov. 15, 2022.

(51) Int. Cl.

| | |
|---|---|
| ***B65D 41/58*** | (2006.01) |
| ***B65D 47/06*** | (2006.01) |
| ***B65D 55/06*** | (2006.01) |
| ***B65D 75/28*** | (2006.01) |
| ***B65D 75/58*** | (2006.01) |

(52) U.S. Cl.

CPC ..... *B65D 41/58* (2013.01); *B65D 47/06* (2013.01); *B65D 55/06* (2013.01); *B65D 75/28* (2013.01); *B65D 75/5877* (2013.01); *B65D 2401/15* (2020.05); *B65D 2547/066* (2013.01)

(58) Field of Classification Search

USPC ..... 222/83.5

See application file for complete search history.

(56) References Cited

U.S. PATENT DOCUMENTS

| | | | | |
|---|---|---|---|---|
| 3,768,501 A | | 10/1973 | Elson | |
| 3,826,221 A | * | 7/1974 | Ross | B65D 79/02 215/230 |
| 4,353,488 A | * | 10/1982 | Schneiter | B67D 3/045 222/501 |

(Continued)

FOREIGN PATENT DOCUMENTS

| | | |
|---|---|---|
| DE | 3510859 A1 | 10/1986 |
| DE | 102020210311 A1 | 2/2022 |

(Continued)

*Primary Examiner* — Paul R Durand
*Assistant Examiner* — Michael J. Melaragno
(74) *Attorney, Agent, or Firm* — The Watson IP Group; Jovan N. Jovanovic

(57) ABSTRACT

A fitment assembly comprising a cap member, a plug member and a tamper cover. The cap member includes a top deck with a central opening and a dispensing tube depending therefrom. The plug member is releasably coupled to the lower end dispensing tube. The plug member includes a base, plug clips and cap clips. The tamper cover is positioned over the central opening of the top deck. The disclosure further includes a flexible container formed with a flexible bag having a spout to which the fitment assembly is coupled as well as to a probe used for dispensing from the flexible container. Methods of use are further disclosed.

20 Claims, 27 Drawing Sheets

(56) References Cited

U.S. PATENT DOCUMENTS

| | | | | | |
|---|---|---|---|---|---|
| 4,375,864 | A | | 3/1983 | Savage | |
| 5,232,125 | A | | 8/1993 | Adams | |
| 5,273,083 | A | * | 12/1993 | Burrows | B67D 1/0835 141/346 |
| 5,284,188 | A | * | 2/1994 | Baker | B67D 3/0032 215/253 |
| 5,370,270 | A | | 12/1994 | Adams | |
| 5,379,918 | A | | 1/1995 | Goto | |
| 5,868,281 | A | * | 2/1999 | Bietzer | B67D 3/0032 141/354 |
| 6,032,812 | A | * | 3/2000 | Lamoureux | B67D 3/0032 141/351 |
| 6,126,045 | A | * | 10/2000 | Last | B65D 51/00 222/499 |
| 6,138,847 | A | * | 10/2000 | Johnson | A61J 9/00 215/11.1 |
| 6,354,473 | B1 | * | 3/2002 | Brambach | B67D 3/0032 222/523 |
| 6,408,904 | B1 | * | 6/2002 | Dushman | B67D 3/0032 141/354 |
| 6,488,165 | B1 | | 12/2002 | Hidding | |
| 6,921,113 | B1 | * | 7/2005 | Vlasblom | B29C 45/006 285/24 |
| 7,886,921 | B2 | * | 2/2011 | Long | B65D 51/20 215/253 |
| 10,526,194 | B2 | | 1/2020 | Van Der Molen | |
| 11,220,379 | B2 | | 1/2022 | Heinbuch | |
| 11,643,257 | B2 | | 5/2023 | Heinbuch | |
| 2004/0045632 | A1 | | 3/2004 | Last | |
| 2004/0144792 | A1 | | 7/2004 | Næsje | |
| 2007/0278175 | A1 | * | 12/2007 | Smith | B67D 3/0032 215/256 |
| 2008/0029540 | A1 | * | 2/2008 | Johnson | B65D 75/5877 222/83 |
| 2008/0054017 | A1 | | 3/2008 | Wang | |
| 2010/0072231 | A1 | * | 3/2010 | Bloom | B65D 47/0842 222/546 |
| 2011/0272405 | A1 | * | 11/2011 | Thurman | B65D 47/0838 220/260 |
| 2012/0284991 | A1 | | 11/2012 | Kusz | |
| 2016/0009536 | A1 | | 1/2016 | Orita | |
| 2017/0066568 | A1 | * | 3/2017 | Stever | B65D 77/068 |
| 2018/0029774 | A1 | * | 2/2018 | Stever | B65D 75/70 |
| 2020/0039704 | A1 | * | 2/2020 | Habitz | B65D 75/5883 |
| 2020/0369443 | A1 | | 11/2020 | Heinbuch | |
| 2021/0001360 | A1 | * | 1/2021 | Johnson | B05B 11/0013 |
| 2022/0135295 | A1 | * | 5/2022 | Ruschmeier | B65D 51/22 222/1 |
| 2022/0297901 | A1 | * | 9/2022 | Kieras | B65D 77/40 |
| 2023/0312190 | A1 | * | 10/2023 | Prinz | B67D 1/0829 137/798 |
| 2023/0356892 | A1 | * | 11/2023 | Darby | B65D 41/02 |
| 2024/0158137 | A1 | * | 5/2024 | Ditore | B65D 75/5877 |

FOREIGN PATENT DOCUMENTS

| | | | | | |
|---|---|---|---|---|---|
| EP | 2258629 | A1 | | 12/2010 | |
| EP | 3892584 | A1 | | 10/2021 | |
| FR | 1134445 | A | | 4/1957 | |
| GB | 871389 | A | | 6/1961 | |
| GB | 2154991 | A | | 9/1985 | |
| GB | 2496465 | A | * | 5/2013 | B67D 7/0294 |
| JP | S56156789 | U | | 11/1981 | |
| JP | 2016155570 | A | | 9/2016 | |
| WO | 9206870 | A1 | | 4/1992 | |
| WO | 9307084 | A1 | | 4/1993 | |
| WO | 9406703 | A1 | | 3/1994 | |
| WO | 9832670 | A1 | | 7/1998 | |
| WO | 0007902 | A1 | | 2/2000 | |
| WO | 2000007902 | A1 | | 2/2000 | |
| WO | 2003031161 | A1 | | 4/2003 | |
| WO | WO-2007062364 | A2 | * | 5/2007 | B65D 41/485 |
| WO | WO-2007146484 | A2 | * | 12/2007 | B65D 47/06 |
| WO | 2011096811 | A1 | | 8/2011 | |
| WO | 2013024611 | A1 | | 2/2013 | |
| WO | 2015022395 | A1 | | 2/2015 | |
| WO | 2015087325 | A1 | | 6/2015 | |
| WO | 2019111285 | A1 | | 6/2019 | |
| WO | WO-2021007138 | A1 | * | 1/2021 | B67D 7/0288 |
| WO | 2023058072 | A1 | | 4/2023 | |
| WO | 2023073237 | A1 | | 5/2023 | |

* cited by examiner

FITMENT ASSEMBLY FOR A FLEXIBLE CONTAINER, FLEXIBLE CONTAINER HAVING A FITMENT ASSEMBLY AND PROBE USED FOR DISPENSING FROM A FLEXIBLE CONTAINER

CROSS-REFERENCE TO RELATED APPLICATION

This application claims priority from U.S. Prov. Patent App. Ser. No. 63/425,661 filed Nov. 15, 2022, entitled "Fitment Assembly For A Flexible Bag, Flexible Bag Having A Fitment Assembly And Probe Used For Dispensing From The Flexible Bag", the entire specification of which is hereby incorporated by reference in its entirety.

BACKGROUND OF THE DISCLOSURE

1. Field of the Disclosure

The disclosure relates in general to flexible packaging, and more particularly, to a fitment assembly for a flexible container, flexible container having a flexible bag and a spout, with a fitment assembly attachable thereto and probe used for dispensing from the flexible container.

2. Background Art

The dispensing of flowable material is known in the art. There are many applications where flowable material is maintained in containers such as, for example, flexible bags, wherein the dispensed flowable material comprises, for example and without limitation, liquids, gels, creams, syrups, dressings, condiments, beverages, among others.

It is desirable to have such flexible bags interface with dispensing probes so that the dispensing probe can be inserted and removed from coupling with the fitment assembly of the flexible bag wherein the probe both unseals and reseals the fitment assembly upon insertion and removal thereof. Additionally, subsequent bags can be coupled to the dispensing probe when the flowable material has been removed from the flexible bag. Advantageously, the flexible bag can be connected and disconnected multiple times without requiring additional closures and the corresponding loss of flowable material, leaking or the compromising of the flowable material within the flexible bag.

There exists a desire for improvement to the operation of the dispensing of flowable material from flexible bags from multiple standpoints, including but not limited to cost savings, performance, manufacturing, use, among others.

SUMMARY OF THE DISCLOSURE

In one aspect of the disclosure, the disclosure is directed to a fitment assembly attachable to a spout, the fitment assembly including a cap member and a plug member. The cap member includes a top deck, a spout and a dispensing tube. The top deck includes an upper surface and a lower surface. The spout coupling member includes an outer dependent skirt and an inner dependent skirt spaced apart from the outer dependent skirt forming a channel structurally configured to accept the spout in sealed engagement therebetween. The dispensing tube defines an elongated bore spaced apart from the inner dependent skirt. The dispensing tube further has an upper end proximate the lower surface of the top deck and terminates at a lower end. The dispensing tube further includes an inner surface having a locking bead positioned between the upper end and the lower end, and a plug sealing bead proximate between the locking bead and the lower end. The plug member includes a base at least two plug clips and at least two cap clips. The base has a central region, and an outward face with a sealing region extending thereabout structurally configured to sealingly engage the plug sealing bead of the dispensing tube. The at least two plug clips are positioned opposite each other and extend from the base. Each plug clip includes a stem and terminating at a head. The head includes an inward tab and an outward tab opposite the inward tab. The at least two cap clips are positioned opposite each other and extending from the base and spaced apart from the at least two plug clips so as to alternate therewith. Each cap clip includes a stem terminating at a head. The head includes an inward tab and an outward tab. The outward tab is structurally configured to releasably engage with the locking bead of the dispensing tube when the plug member is in a sealed orientation. The inward tabs of the at least two plug clips extend inwardly beyond the inward tabs of the at least two cap clips, and the outward tabs of the at least two cap clips extend outwardly beyond the outward tabs of the at least two plug clips.

In some configurations, the fitment assembly further includes a tamper cover removably positionable over the upper surface of the top deck. The tamper cover has an outer perimeter with a plurality of pull tabs outward nubs extending outwardly from the outer perimeter in a spaced apart orientation. The upper surface of the top deck further includes a plurality of guard nubs extending from the surface and spaced apart from each other at an outer surface of the top deck. The guard nubs define a valley therebetween. The spacing between the guard nubs about the top deck and the pull tab outward nubs of the tamper cover, results in at least one pull tab outward nub aligning with a valley between two guard nubs of the plurality of guard nubs.

In some configurations, three guard nubs are uniformly spaced apart from each other about the top deck and four pull tab outward nubs are uniformly spaced apart from each other about the outer perimeter of the tamper cover.

In some configurations, a channel hoop region extends about the central region, with the outer face forming a portion of the central region, and further defining a channel between the outer face and the central region. The channel provides flexibility so that upon sealed engagement with the plug sealing bead of the dispensing tube, the ring region is outwardly biased against the plug sealing bead.

In some configurations, a circumferential flange extends about a lower end of the outward face and is configured to interface with the lower end of the dispensing tube when the plug member is in the sealed orientation.

In some configurations, the circumferential flange and the central region of the base are substantially coplanar and define a lower surface of the plug member.

In some configurations, the circumferential flange and the outward face are substantially perpendicular to each other.

In some configurations, the central region further includes a ring region outboard thereof and inboard of the channel hoop region. The channel hoop region has an inner face extending from an upper surface of the ring region, with the central region, the upper surface and the inner face together cooperating to form a cavity structurally configured to receive a lower end of a probe. The inner face and the upper surface of the ring region are substantially perpendicular to each other.

In some configurations, the stems of each of the at least two plug clips and the stems of each of the at least two cap clips are spaced apart from the inner face of the channel hoop region.

In some configurations, the stems of each of the at least two plug clips and the stems of each of the at least two cap clips are spaced apart from the outward face.

In some configurations, the stems of the at least two plug clips are inboard of the stems of the at least two cap clips.

In some configurations, the locking bead and the plug sealing bead are spaced apart from each other along the inner surface of the dispensing tube.

In some configurations, the plug sealing bead is spaced apart from the lower end of the dispensing tube.

In some configurations, the inward tab of each of the at least two cap clips define a face such that the two opposing faces of the inward tabs of the at least two cap clips define a cylindrical configuration.

In some configurations, the inward tab of each of the at least two cap clips terminate at a lower end with a flange, wherein the flange is perpendicular to the face.

In another aspect of the disclosure, the disclosure is directed to a flexible container. The flexible container includes a flexible bag, a spout and a fitment assembly. The flexible bag has a plurality of panels having a plurality of seals to define a cavity, and with an opening providing communication with the cavity. The spout has a base flange and an upstanding member extending from the base flange terminating at an upper edge. The base flange is coupled to the bag about the opening in fluid tight engagement the upstanding member defining a channel that is in fluid communication with the cavity. The fitment assembly can be any of the fitment assembly configurations as described hereinabove or hereinbelow, wherein the upstanding member extends into the channel formed by the inner dependent skirt and the outer dependent skirt and is in sealed engagement therein.

In some configurations, the opening is formed in a panel of the plurality of panels.

In some configurations, the flexible container includes a central flange disposed on an outer surface of the upstanding member, with the outer dependent skirt being spaced apart from the central flange.

In some configurations, the dispensing tube and plug member are structurally configured so that the plug member can go between a sealed orientation and an unsealed orientation while the plug member remains within the channel of the upstanding member.

In some configurations, the plug member is structurally configured to extend fully beyond the channel of the upstanding member.

In another aspect of the disclosure, the disclosure is directed to a probe configured for use in association with the flexible container as described herein above, or hereinbelow. The probe includes a body including an outer surface, and an inner bore, a locking portion, a seal, a probe bore, an upper interfacing ridge and a locking portion. The probe is structurally configured to be insertable into the dispensing tube of the cap member. The locking portion is disposed at a lower end of the body. The seal is disposed about the outer surface spaced apart from the locking portion. The seal is configured for sealing engagement between the dispensing tube and the body of the probe. The probe bore extends therethrough and terminates at a bore opening through the outer surface. The bore opening is defined between the locking portion and the seal. The upper interfacing ridge is positioned between the upper portion and the locking portion. The upper interfacing ridge is configured to engage the locking bead to preclude further insertion of the probe into the dispensing tube. The locking portion is structurally configured to engage the plug clips of the plug member so as to releasably engage therewith, wherein the probe is configured to direct the plug member between the sealed orientation and the unsealed orientation, while being releasably coupled thereto.

In some configurations, the seal member sealingly engages the dispensing tube in sealed engagement prior to the probe directing the plug member from the sealed orientation to the unsealed orientation.

In some configurations, the locking portion further includes an upper end and a lower end, a clip engagement tab and a wall. The clip engagement tab is structurally configured to engage at least the inward tabs of the at least two plug clips of the cap member, while being able to elastically deform the at least two plug clips of the cap member during engagement. The well defines a channel positioned between the dispensing opening and the clip engagement tab. The well is configured to receive at least the inward tabs of the at least two plug clips therewith.

In yet another aspect of the disclosure, the disclosure is directed to a method of dispensing comprising the steps of: providing the flexible container and the probe; directing a probe into the dispensing tube; forming a seal between the dispensing tube and outer surface of the probe; releasably engaging the plug member with the locking portion of the probe; directing the probe inwardly to direct the plug member from a sealed orientation to an unsealed orientation; and withdrawing flowable material from within the cavity of the flexible bag through the probe.

In some configurations, the method further includes the steps of directing the probe outwardly to direct the plug member from the unsealed orientation to the sealed orientation; releasing the plug member from the probe; and removing the probe from the dispensing tube.

In some configurations, the cap member further includes a tamper cover positioned over the dispensing tube. In such configurations, the method further includes the step of: removing the tamper cover prior to the step of directing the probe into the dispensing tube.

In some configurations, the step of directing the probe inwardly to direct the plug member from a sealed orientation to an unsealed orientation can occur while maintaining the probe within the channel of the spout.

BRIEF DESCRIPTION OF THE DRAWINGS

The disclosure will now be described with reference to the drawings wherein.

DETAILED DESCRIPTION OF THE DISCLOSURE

Figure 1:
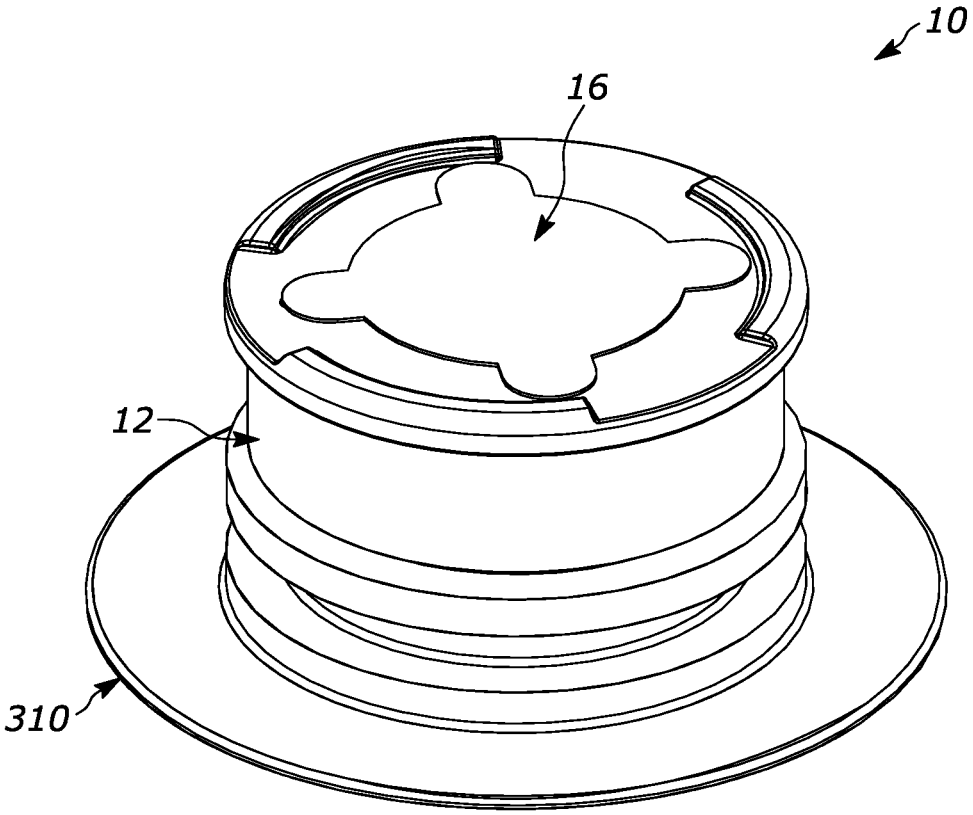
FIG. 1 of the drawings is a perspective view of the fitment assembly of the present disclosure coupled to a spout attachable to a flexible bag.
Figure 2:
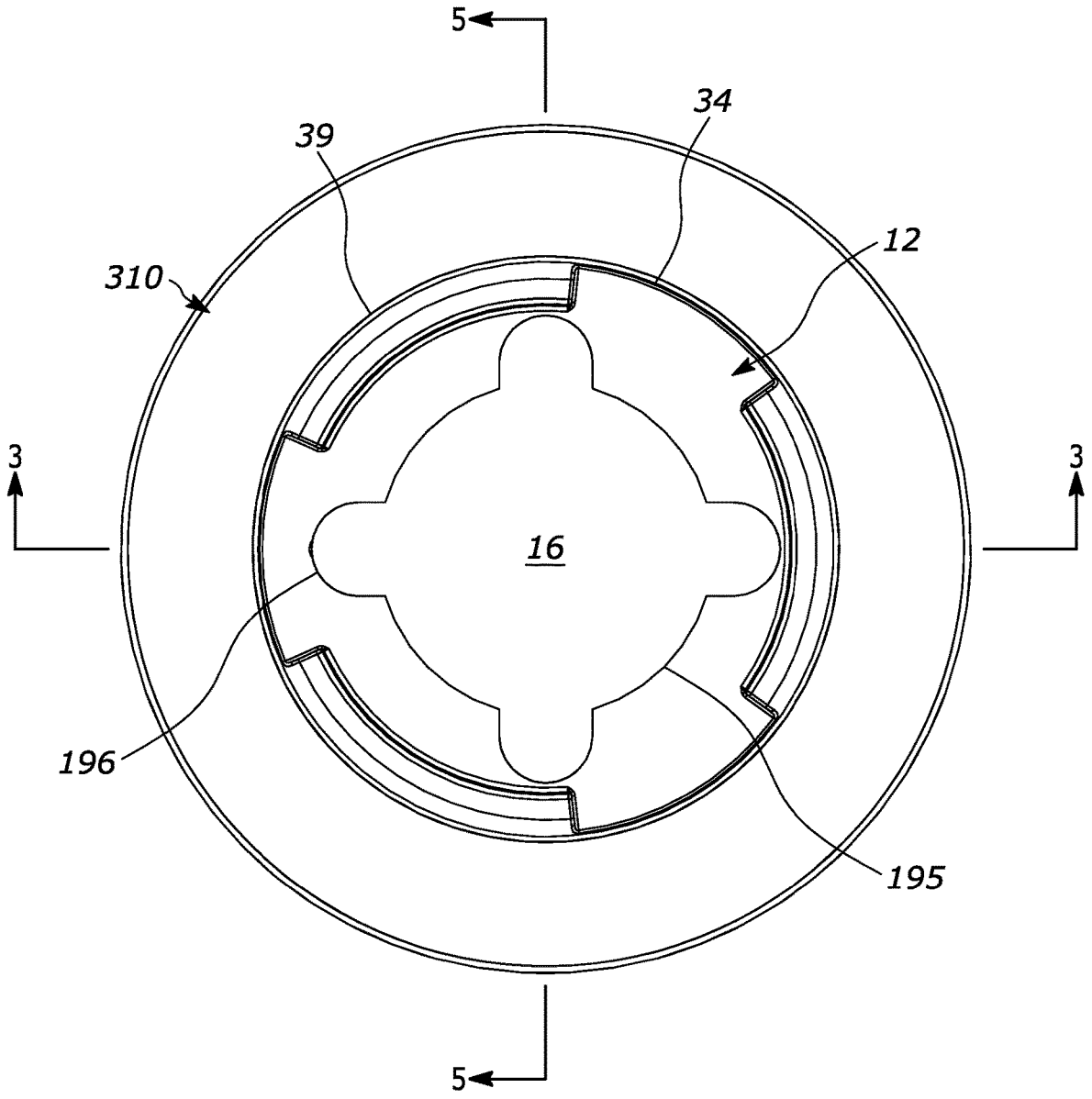
FIG. 2 of the drawings is a top plan view of the fitment assembly coupled to a spout attachable to a flexible bag.
Figure 3:
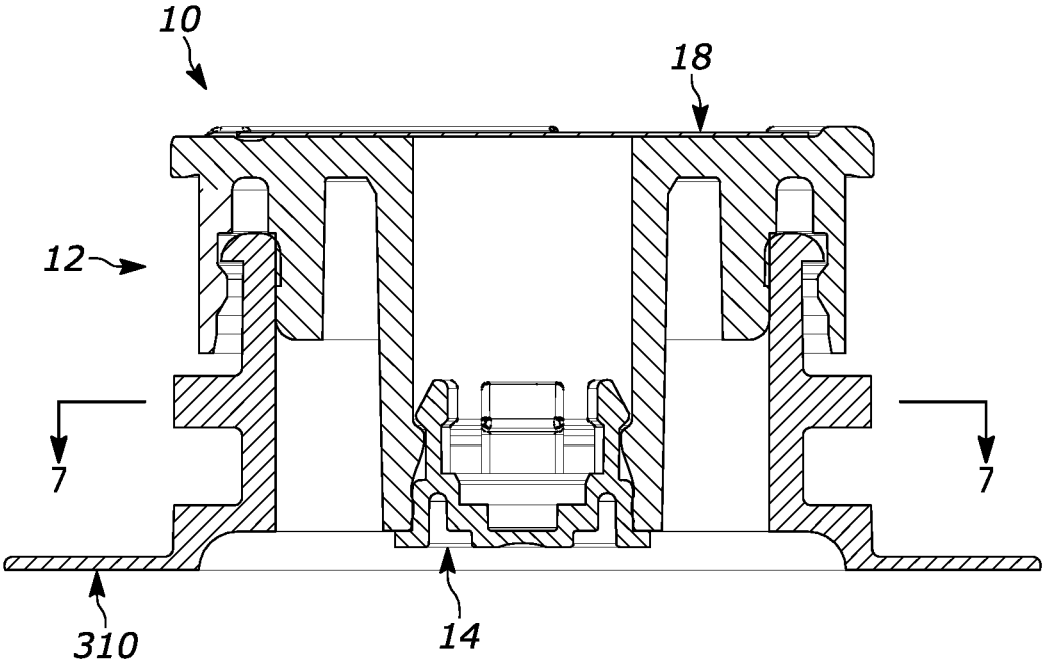
FIG. 3 of the drawings is a cross-sectional view of the fitment assembly coupled to a spout attachable to a flexible bag taken generally about lines 3-3 of FIG. 2.
Figure 4:
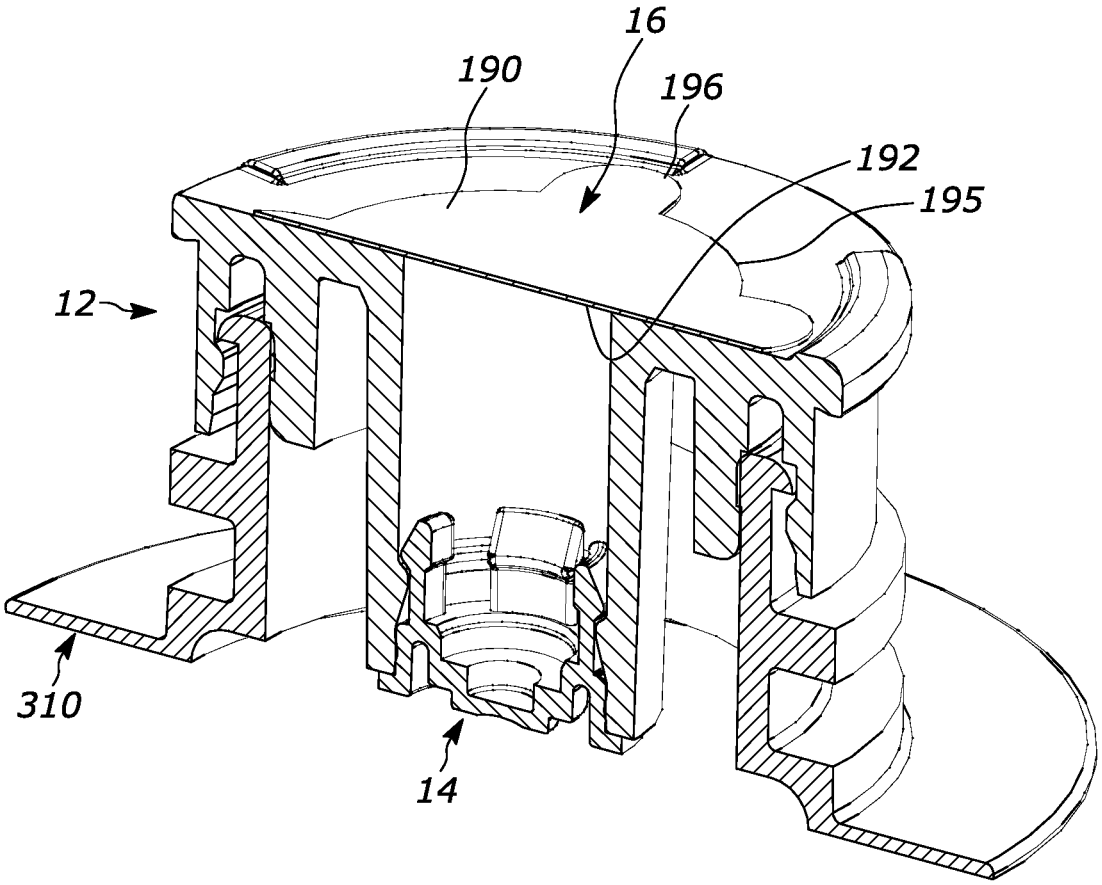
FIG. 4 of the drawings is a perspective cross-sectional view of the fitment assembly coupled to a spout attachable to a flexible bag of FIG. 3.
Figure 5:
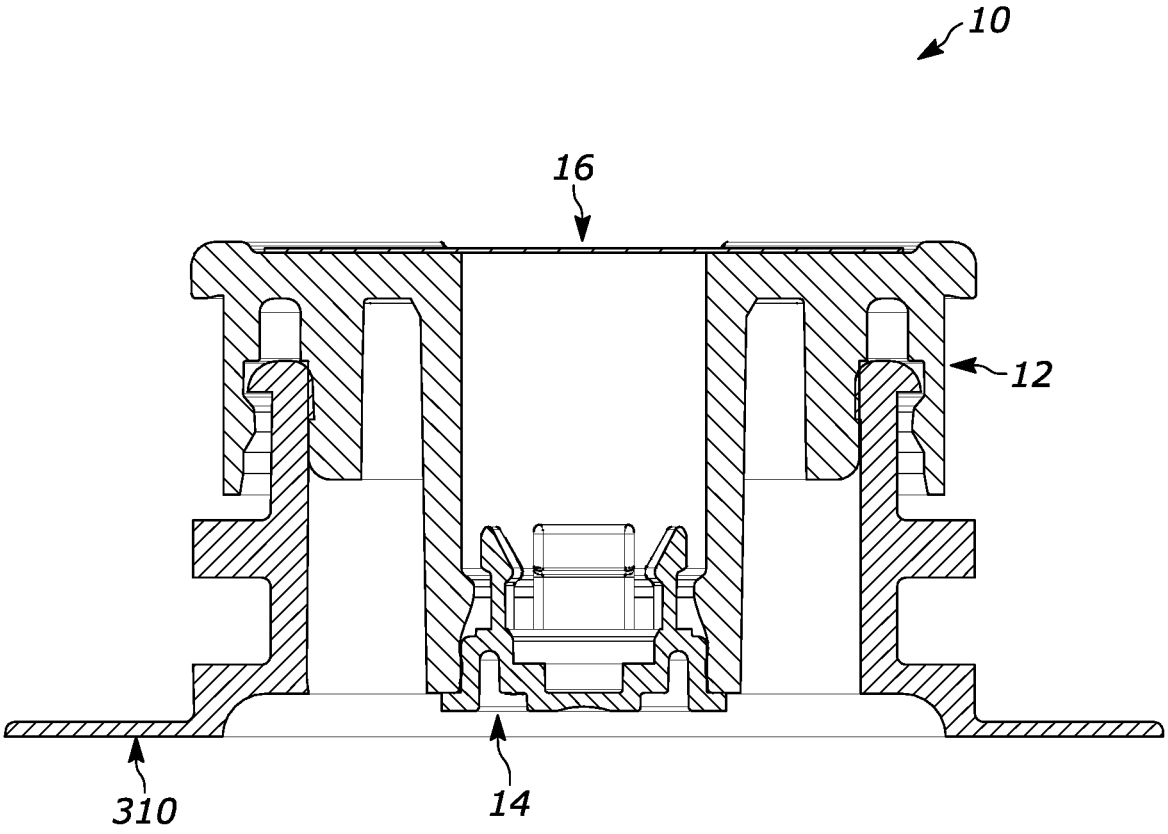
FIG. 5 of the drawings is a cross-sectional view of the fitment assembly coupled to a spout attachable to a flexible bag taken generally about lines 5-5 of FIG. 2.
Figure 6:
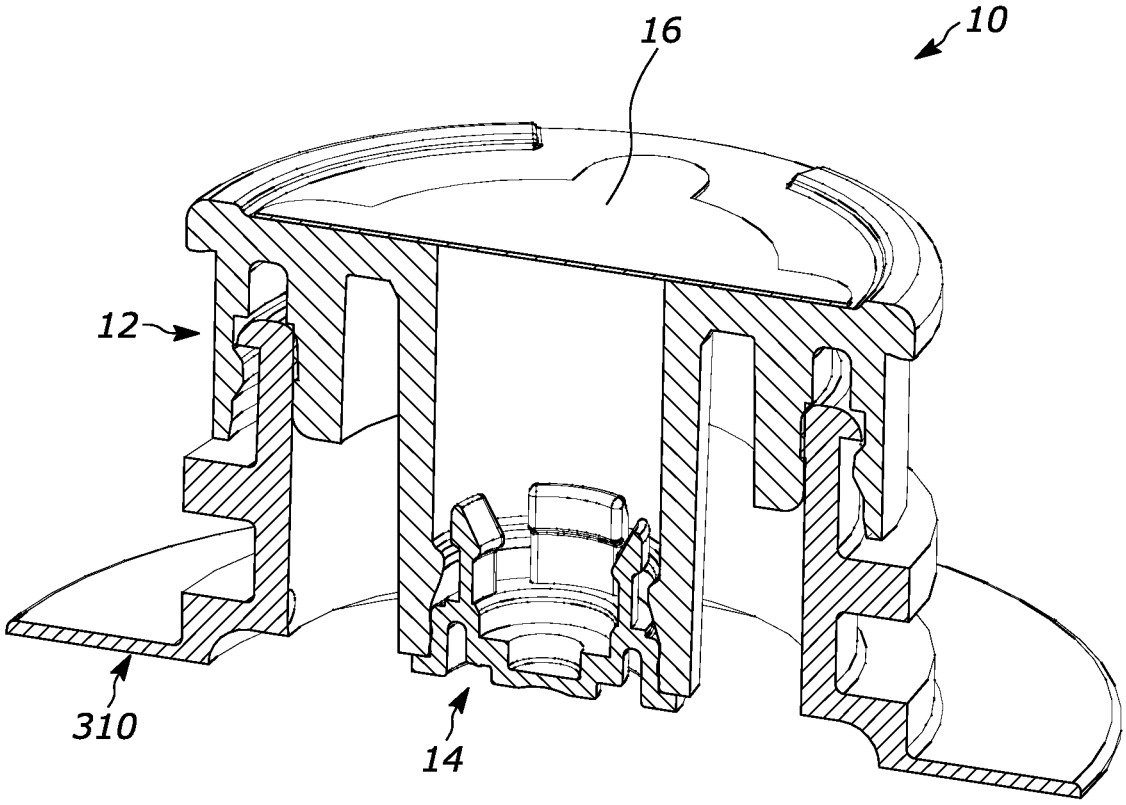
FIG. 6 of the drawings is a perspective cross-sectional view of the fitment assembly coupled to a spout attachable to a flexible bag of FIG. 5.
Figure 7:
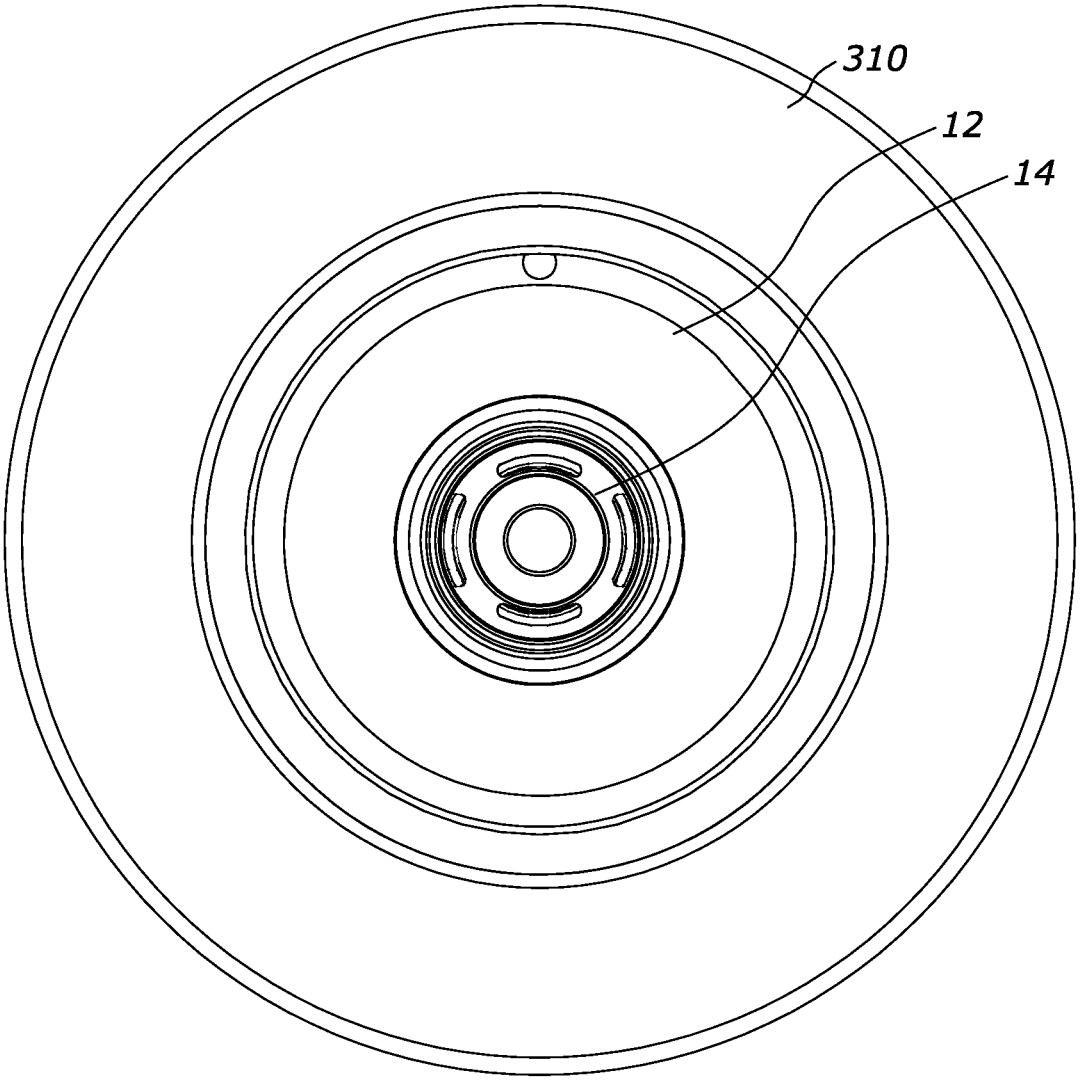
FIG. 7 of the drawings is a cross-sectional view of the fitment assembly coupled to a spout attachable to a flexible bag, taken generally about lines 7-7 of FIG. 3.
Figure 8:
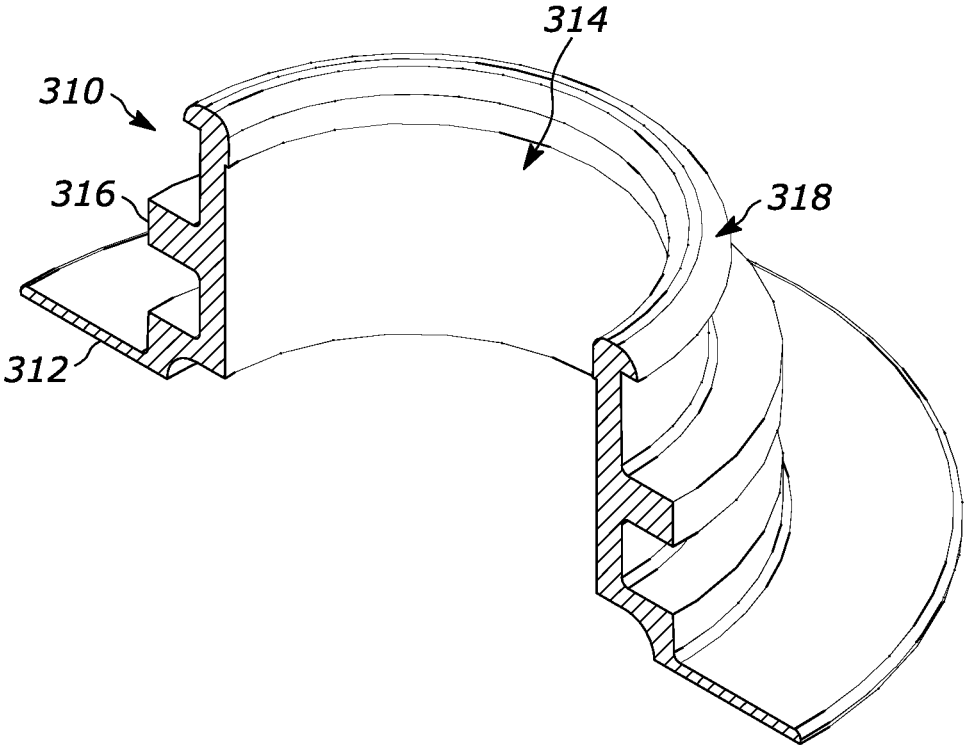
FIG. 8 of the drawings is a perspective cross-sectional view of the spout for use with the fitment assembly of the present disclosure.
Figure 9:
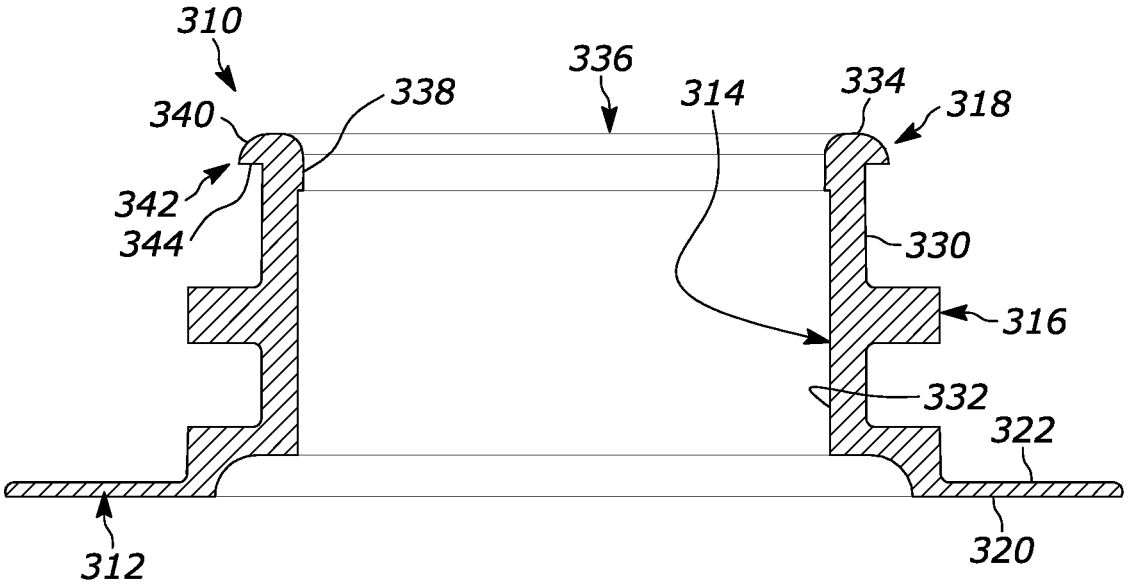
FIG. 9 of the drawings is a cross-sectional view of the view of the spout for use with the fitment assembly of the present disclosure.
Figure 10:
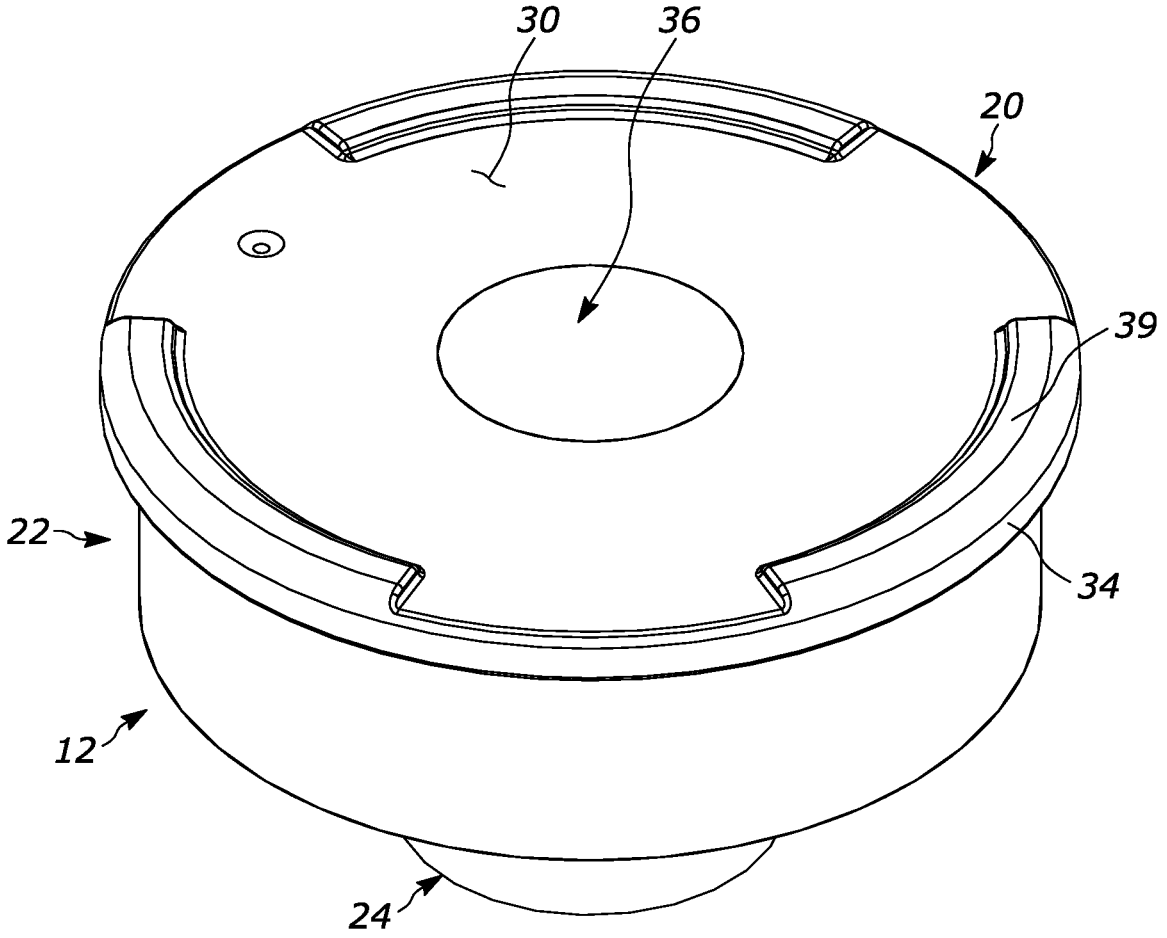
FIG. 10 of the drawings is a perspective view of the cap member of the fitment assembly of the present disclosure.
Figure 11:
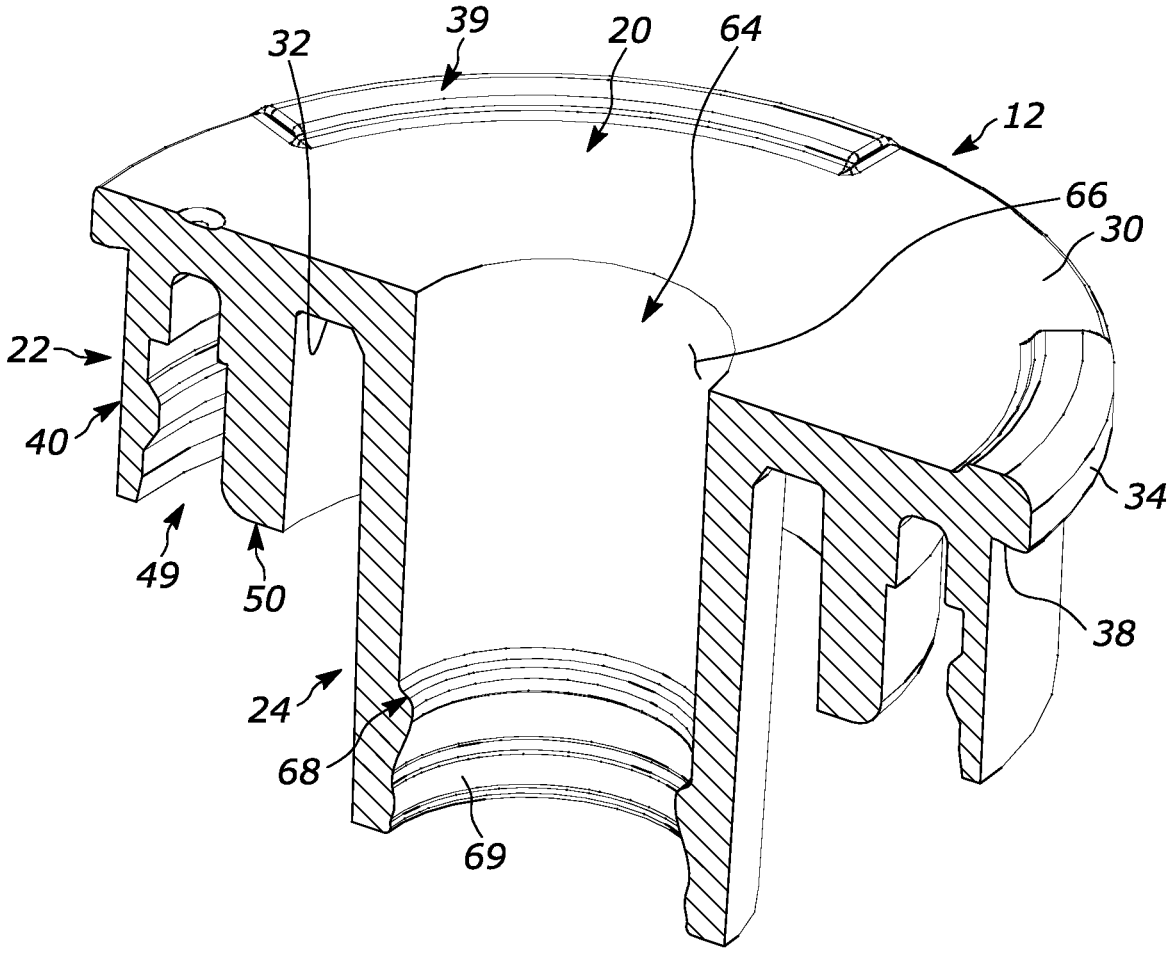
FIG. 11 of the drawings is a perspective view of the cap member of the fitment assembly of the present disclosure.
Figure 12:
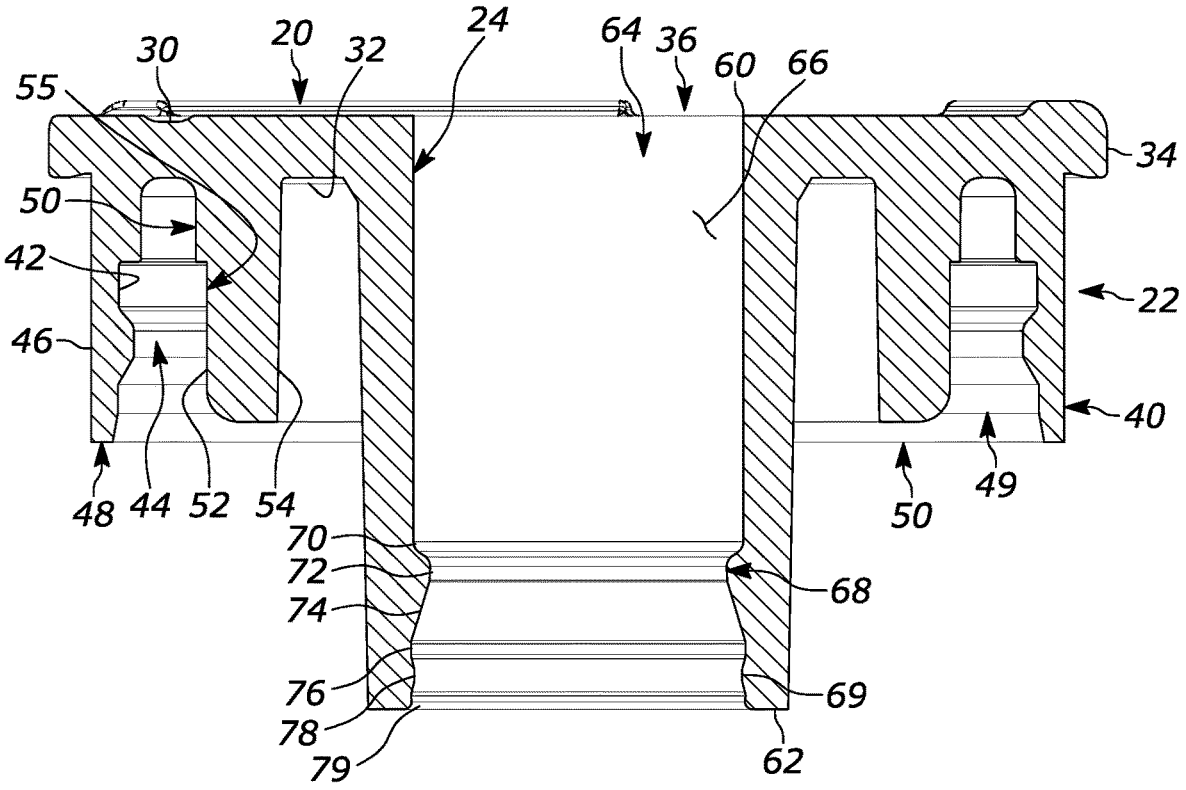
FIG. 12 of the drawings is a cross sectional view of the cap member of the fitment assembly of the present disclosure.
Figure 13:
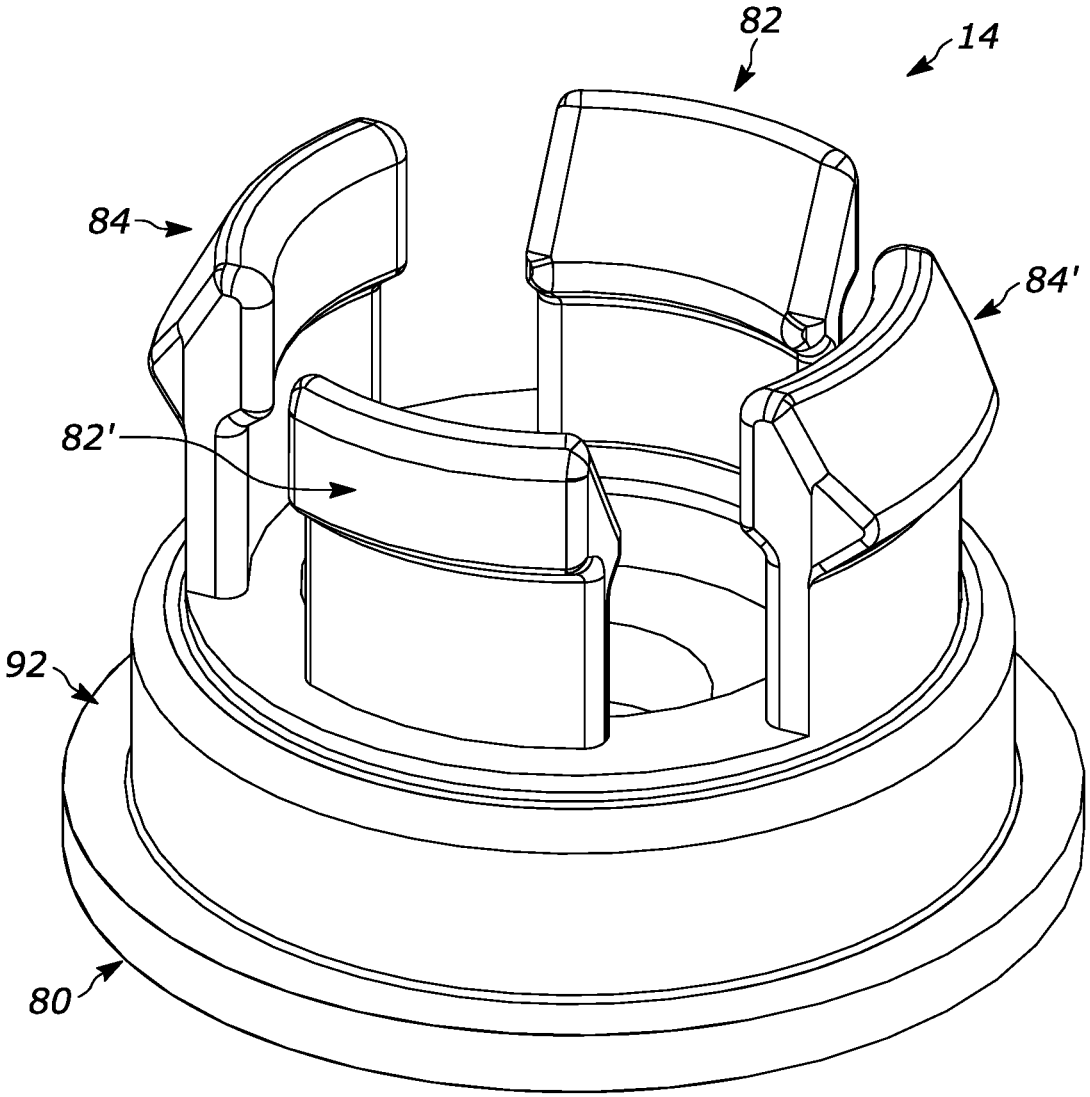
FIG. 13 of the drawings is a perspective view of the plug member of the fitment assembly of the present disclosure.
Figure 14:
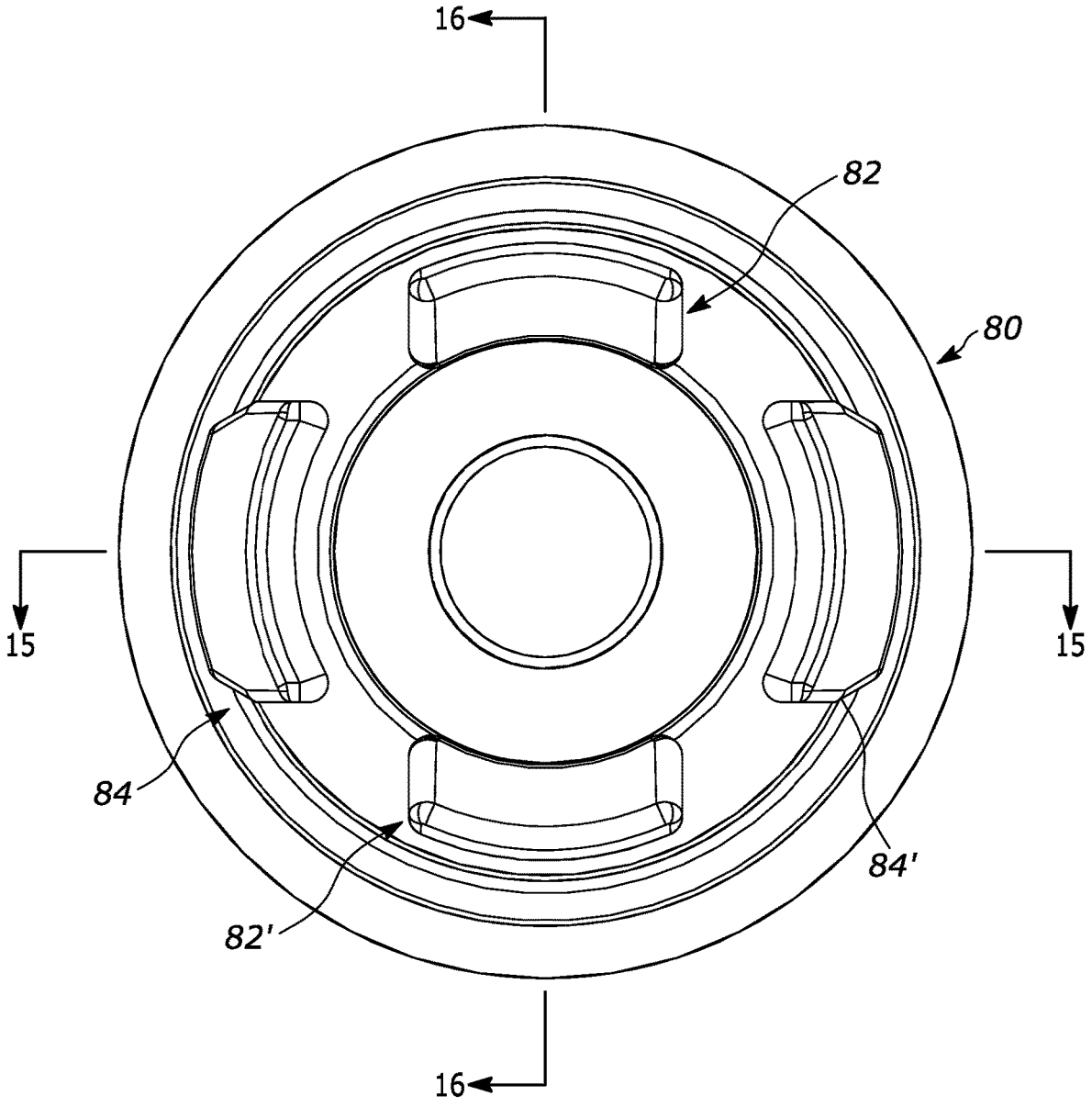
FIG. 14 of the drawings is a bottom plan view of the plug member of the fitment assembly of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1, 2, 3, 18 and 26, the fitment assembly is shown generally at 10. The fitment assembly is configured for attachment to a spout 310 which is attached to a flexible bag 300 (forming a flexible container). A probe, such as probe 350 may be coupled to the fitment assembly so as to selectively allow for dispensing (and/or filling) of the flexible bag through the probe, and the cap member. It is contemplated that the probe may be coupled to different types of dispensing machines which can remove the contents of the flexible bag through the probe.

The flexible bag is shown as comprising a plurality of panels 302, which are coupled together with seals 304 (and/or folds) so as to define a fluid tight cavity 306. An opening 308 is provided for communication to the cavity 306. A spout may be sealingly engaged to the flexible bag about the opening 308. The flexible bag may contain any number of different flowable materials, including but not limited to liquids, gels, creams, syrups, dressings, condiments, beverages, without limitation.

The spout 310 comprises base flange 312, upstanding member 314, central flange 316 and upper flange 318. The base flange 312 includes lower surface 320 and upper surface 322. One of the upper surface and the lower surface are coupled to the flexible bag about the opening (or both, for example where multiple plies are be utilized, while multiple plies may be coupled to only one of the surfaces) so as to sealingly engage therewith. The upstanding member 314 extends from the base flange and includes outer surface 330 and inner surface 332. The upstanding member extends from the base flange and terminates at an upper edge 334. The inner surface 332 of the upstanding member defines a channel which is in fluid communication (or can be placed in fluid communication) with the cavity of the flexible bag. At an upper end of the inner surface, a spout sealing surface 338 is defined.

The central flange 316 extends about the outer surface 330 between the upper edge 334 of the upstanding member and the base flange 312. In the configuration shown, a single central flange is presented. In the configuration shown, the base flange and the central flange are parallel to each other, and parallel to a plane defined by the upper edge. It will be understood that multiple central flanges may be disposed on the outer surface of the upstanding member, and their orientations relative to the base flange and the upstanding member can be varied.

The upper flange 318 includes upper surface 340, lower surface 342 which defines a lower edge. As will be explained below, the upper flange facilitates the retention of the cap member to the spout.

Referring again to Figures, the fitment assembly 10 includes cap member 12, pug member 14 and tamper cover 16. The cap member 12 includes top deck 20, spout coupling member 22 and dispensing tube 24. In the configuration shown, the cap member comprises an integrally molded polymer member, while other configurations are contemplated (3d printed, among others). The top deck 20 includes upper surface 30, lower surface 32 opposite the upper surface 30, an outer surface 34 and central opening 36. The upper surface is substantially planar across to the outer surface, and may further include arcuate guard nubs 39 extending outwardly therefrom (in this case three are positioned in a spaced apart arcuate orientation, the outer edges of which align with the outer surface 34 of the top deck and define a valley therebetween). The top deck and the interface with the outer dispensing skirt 40 defines an outer flange 38. In the configuration shown, the top deck 20 is substantially circular, as is the outer depending skirt. Of course, other configurations are contemplated for the cap member, and also for the top deck and outer depending skirt (among other components).

The spout coupling member 22 comprises outer depending skirt 40, and inner depending skirt 50 which are generally spaced apart from each other radially, and generally concentrically with the central opening, wherein the outer and inner depending skirts define a channel 49 therebetween. The outer depending skirt 40 includes inner surface 42, outer surface 46 terminating at lower edge 48. The inner surface includes spout locking bead 44 which extends about the inner surface and projects inwardly (and is ramped on either side thereof). In the attached configuration, the spout locking bead 44 interfaces with the upper flange to capture the upper flange and to preclude inadvertent disengagement of the cap member from the spout.

The inner depending skirt 50 includes an outer surface 52 and an inner surface 54 opposite the outer surface. The outer surface includes a sealing region 55 which is sized and configured to compressingly engage with the spout sealing surface 338 at an upper end of the upstanding member of the spout.

The dispensing tube 24 surrounds the central opening 36, and in the configuration shown, concentrically with the inner depending skirt, being axially spaced apart from the inner surface 54 thereof. The dispensing tube 24 includes upper end 60, lower end 62 defining an elongated bore 64 with an inner surface 66. In the configuration shown, the dispensing tube extends further from the lower surface of the top deck than the inner and outer depending skirts and, in the configuration shown, the lower end of the dispensing tube approaches the lower end of the upstanding member of the spout.

A locking bead 68 circumferentially extends inwardly from the inner surface 66 of the dispensing tube between the upper end and the lower end thereof, and in the configuration shown, is closer to the lower end of the dispensing tube. The locking bead includes a upper region 70, a central region 72 and a lower region 74. The lower region is inclined toward the central region from the inner surface of the dispensing tube and has a smaller slope than the upper region that is likewise inclined from the inner surface to the central region on a side opposite the lower region. In the configuration shown, the vertical length of the upper region is substantially shorter than that of the lower region. As can be see in the Figures, the upper region 70 of the locking bead shape matingly matches the shape of the lower end 172 of the outward tabs 170 of the head of the cap clips 84. And, the lower region 74 provides a ramp to direct the head of the cap clip inwardly so that through continued movement the cap clips can extend beyond the locking bead 68. The locking bead is configured to releasably lock with the cap clips of the plug member to facilitate retention therebetween upon insertion of the probe.

The plug sealing bead 69 is shown as being between the locking bead 68 and the lower end 62 of the dispensing tube. The plug sealing bead 69 includes an upper region 76, a central region 78 and a lower region 79. The plug sealing bead extends inwardly from the inner surface 66 of the dispensing tube axially a distance that is not as far inward as the locking bead so as to substantially preclude interference with the cap clips of the plug member. In the configuration shown, the plug sealing bead is substantially semicircular in cross-sectional configuration so that the upper and lower regions are generally arcuately curved and generally mirror images of each other. The plug sealing bead is configured so as to interfere with the sealing region 124 of the base of the plug member 14 to form a hermetic seal therebetween.

The plug member 14 is shown as comprising base 80, plug clips 82, 82' and cap clips 84, 84'. The plug member likewise comprises a molded polymer member, while other materials and manufacturing methods are contemplated. The base 80 of the plug member defines lower region 90 and upper region 92 opposite the lower region 90. The base is formed from a plurality of regions, such as, central hub region 94, ring region 96 and channel hoop region 98. The central hub region 94 includes an outer surface 100. The ring region 96 extends from the central hub region and includes inner surface 102, lower flange 104 and upper surface 106. The channel hoop region 98 defines channel 108 having a first surface 111 and second surface 112. This channel 108 provides a flexibility to the outward face 116 relative to the central hub region and the ring region so that upon sealed engagement, the outward face is biased outwardly toward the inner surface of the dispensing tube. Additionally, the channel hoop region 98 defines an outer configuration having an inner face 114, and an outward face 116, and an upper portion 118 spanning therebetween (and from which the plug and cap clips emanate). The inner face meets an inner ring 120 of the upper portion 118 so as to define a chamfer, while the upper surface 106 and the inner face 114 are preferably perpendicular to each other. It will be understood that the central hub 94, the inner surface of the ring region 102 and the inner face 114 of the outer configuration along with lower wall form a cavity to receive the locking portion 358 (Figures) of the probe 350.

The outward face 116 generally matches the shape of the inner surface of the dispensing tube and includes sealing region 124. The sealing region 124 engages the plug sealing bead 69 in sealed engagement. Finally, a circumferential flange 99 extends about the lower end of the outward face 116 and is configured to interface with the lower end 62 of the dispensing tube as the cap clips are engaged with the upper region of the locking bead 68 of the dispensing tube 24, thereby precluding further insertion and forming the lowermost portion of the plug member. In the configuration shown, the circumferential flange together and the central region forming a lower surface of the plug member and being substantially coplanar. The lower surface being substantially parallel to the lower end of the dispensing tube and also base flange of the spout 110 when in the installed configuration.

The plug clips 82, 82' are positioned on opposite sides of each other (i.e., 180° apart) and are generally mirror images of each other about a plane bisecting the plug member in half. As such, plug clip 82 will be described with the understanding that plug clip 82' is substantially identical in structure. Plug clip 82 has an arcuate configuration that extends upwardly from the upper portion 118 (and preferably outboard of, or, spaced apart from, the inner face of the channel hoop region) of the base 80 and includes stem 130 terminating at head 136. The stem 130 comprises a lower end 132 at the upper portion 118 of the base 80 and an upper end 134. The head 136 is positioned at the upper end 134 of the stem 130. The head 136 includes outward tab 140 and inward tab 148. The outward tab 140 includes lower end 142, upper end 144 and central region 146 and is preferably substantially planar (i.e., defining a configuration that is generally concentric with the dispensing tube). The configuration of the outward tab of the plug clips is such that the plug clips pass beyond the locking bead 68 and the plug sealing bead 69 of the dispensing tube, and upon insertion of the probe, the outward tab may engage the locking bead (i.e., the lower end 142 of the outward tab 140 engages the upper region 70 of the locking bead). The inward tab 148 is configured to have the upper end 150 inclined inwardly to the central region 151 (so as to, collectively, define a generally conical configuration) and the lower end 152 inclined inwardly to the central region 151. The slope of the upper end being smaller than that of the lower end, with the upper end being configured to interface with the plug to direct the clips outwardly to permit the plug to extend beyond the head, with the lower end engaging the upper flange of the plug so as to preclude inadvertent disconnection of the plug from the probe.

Figure 15:
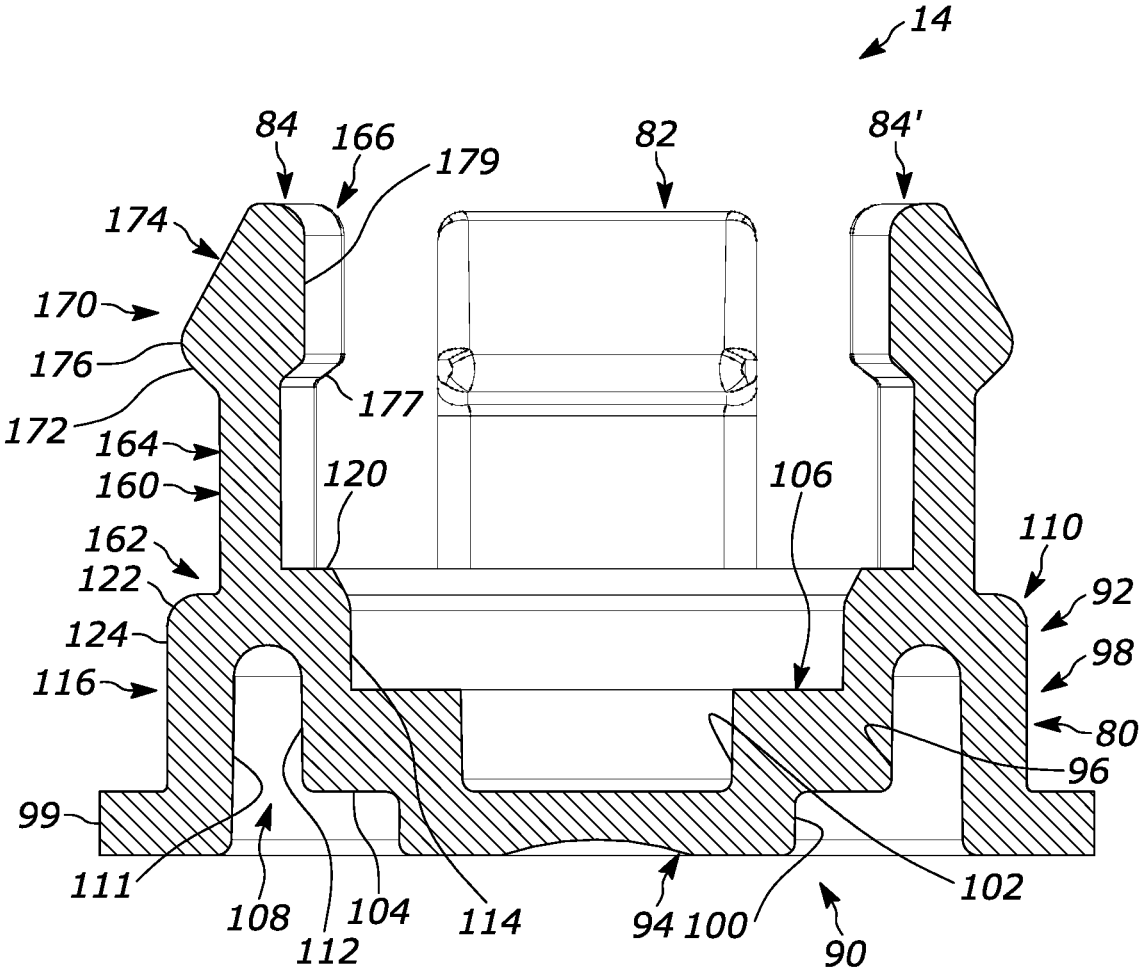
FIG. 15 of the drawings is a cross-sectional view of the plug member of the fitment assembly of the present disclosure taken generally about lines 15-15 of FIG. 14.
Figure 15B:
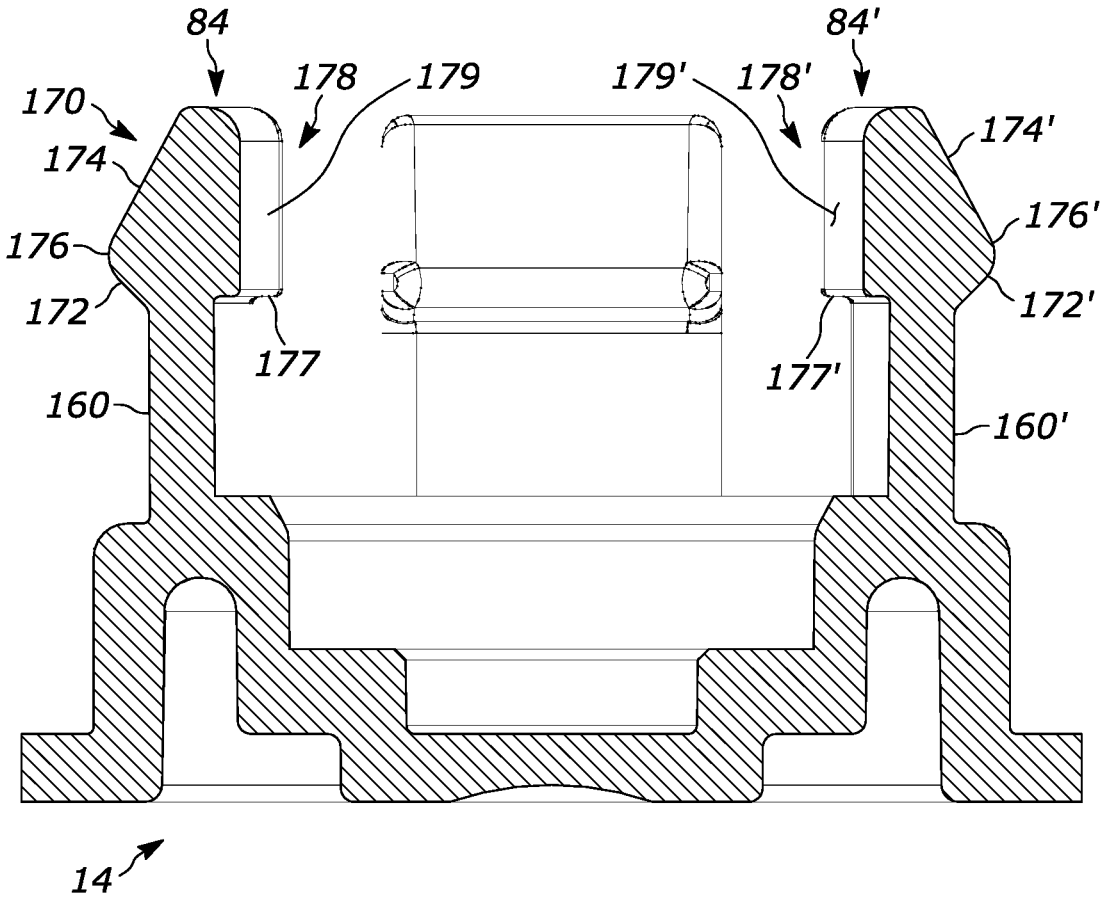
FIG. 15*b* of the drawings is a cross-sectional view of another plug member of the fitment assembly of the present disclosure.
Figure 16:
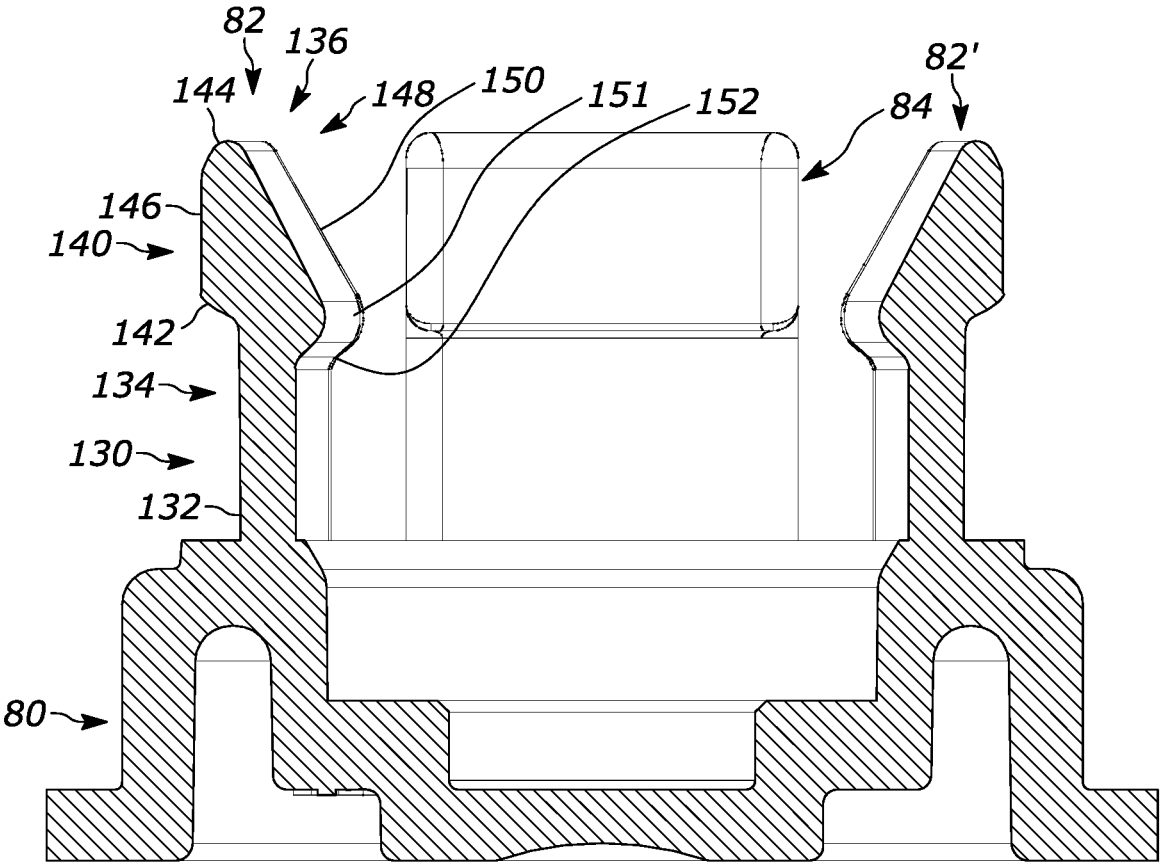
FIG. 16 of the drawings is a cross-sectional view of the plug member of the fitment assembly of the present disclosure taken generally about lines 16-16 of FIG. 14.
Figure 17:
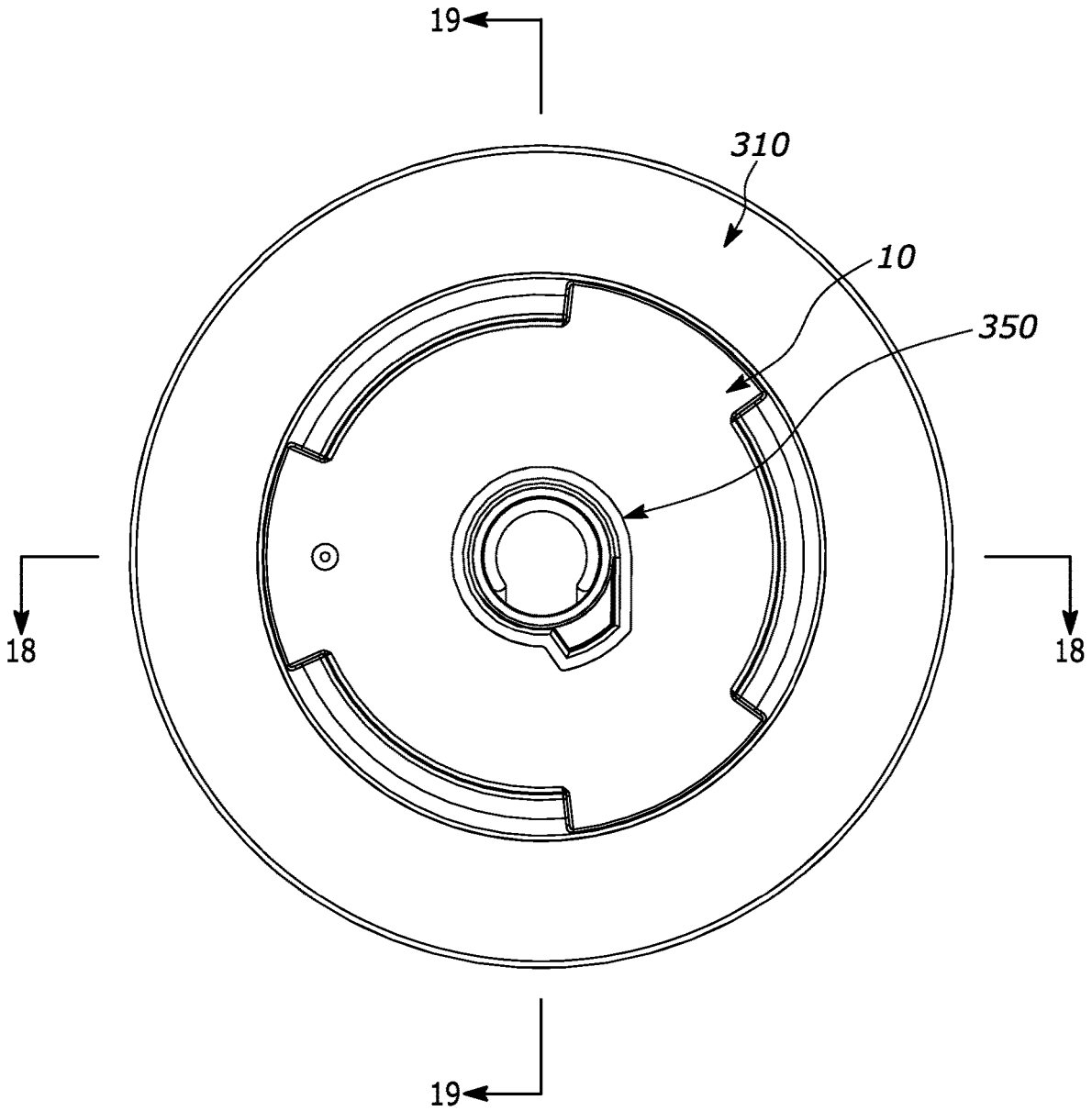
FIG. 17 of the drawings is a top plan view of the fitment assembly coupled to a spout attachable to a bag, with a probe extending through the dispensing tube of the cap member.
Figure 18:
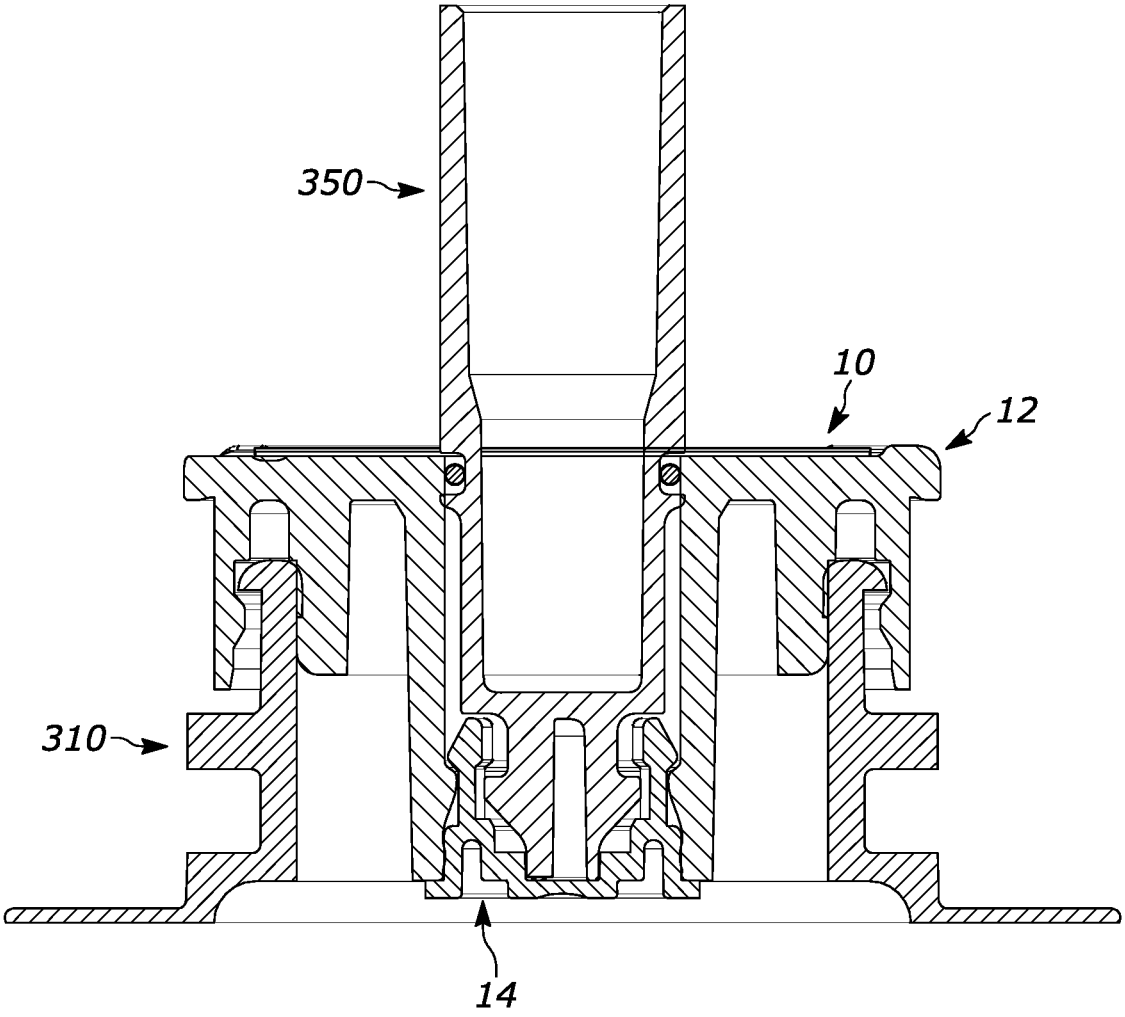
FIG. 18 of the drawings is a cross-sectional view of the fitment assembly coupled to a spout attachable to a bag, with a probe extending through the dispensing tube of the cap member taken generally about lines 18-18 of FIG. 17.
Figure 19:
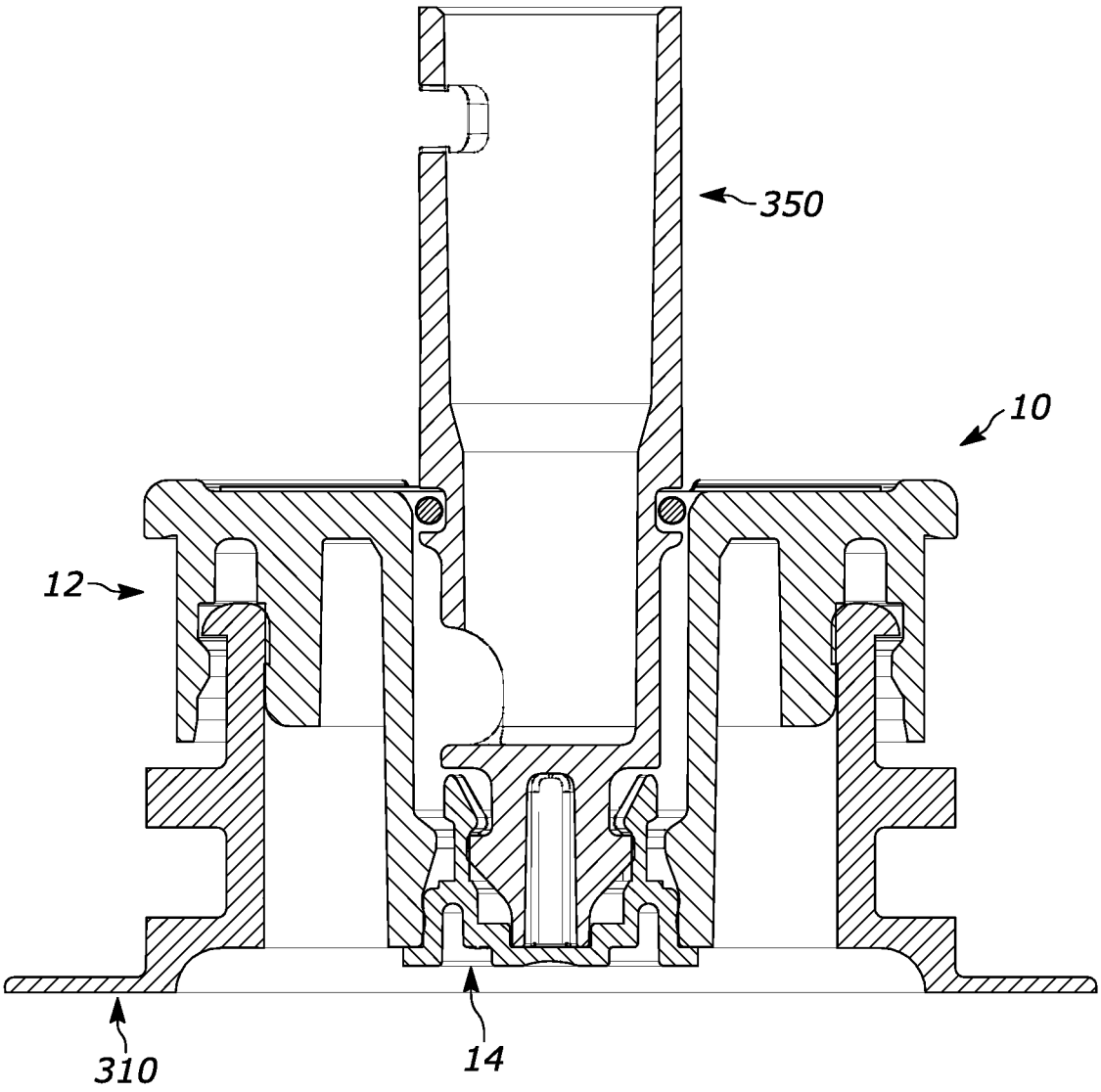
FIG. 19 of the drawings is a cross-sectional view of the fitment assembly coupled to a spout attachable to a bag, with a probe extending through the dispensing tube of the cap member taken generally about lines 19-19 of FIG. 17.
Figure 20:
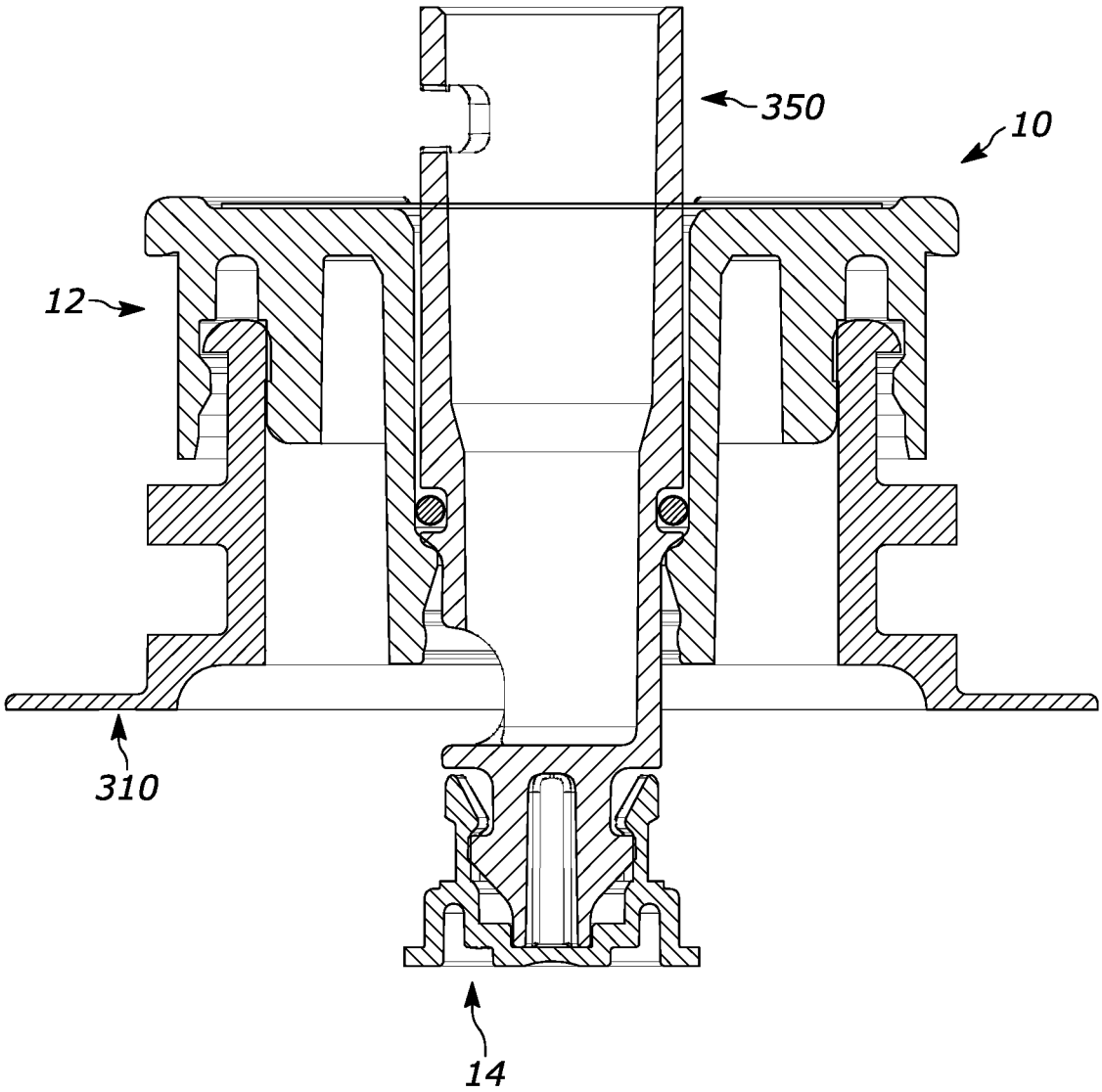
FIG. 20 of the drawings is a cross-sectional view of the structure shown in FIG. 19, however, the probe has been directed through the dispensing tube, coupling to the plug member and disconnecting the plug member from engagement with the dispensing tube.
Figure 21:
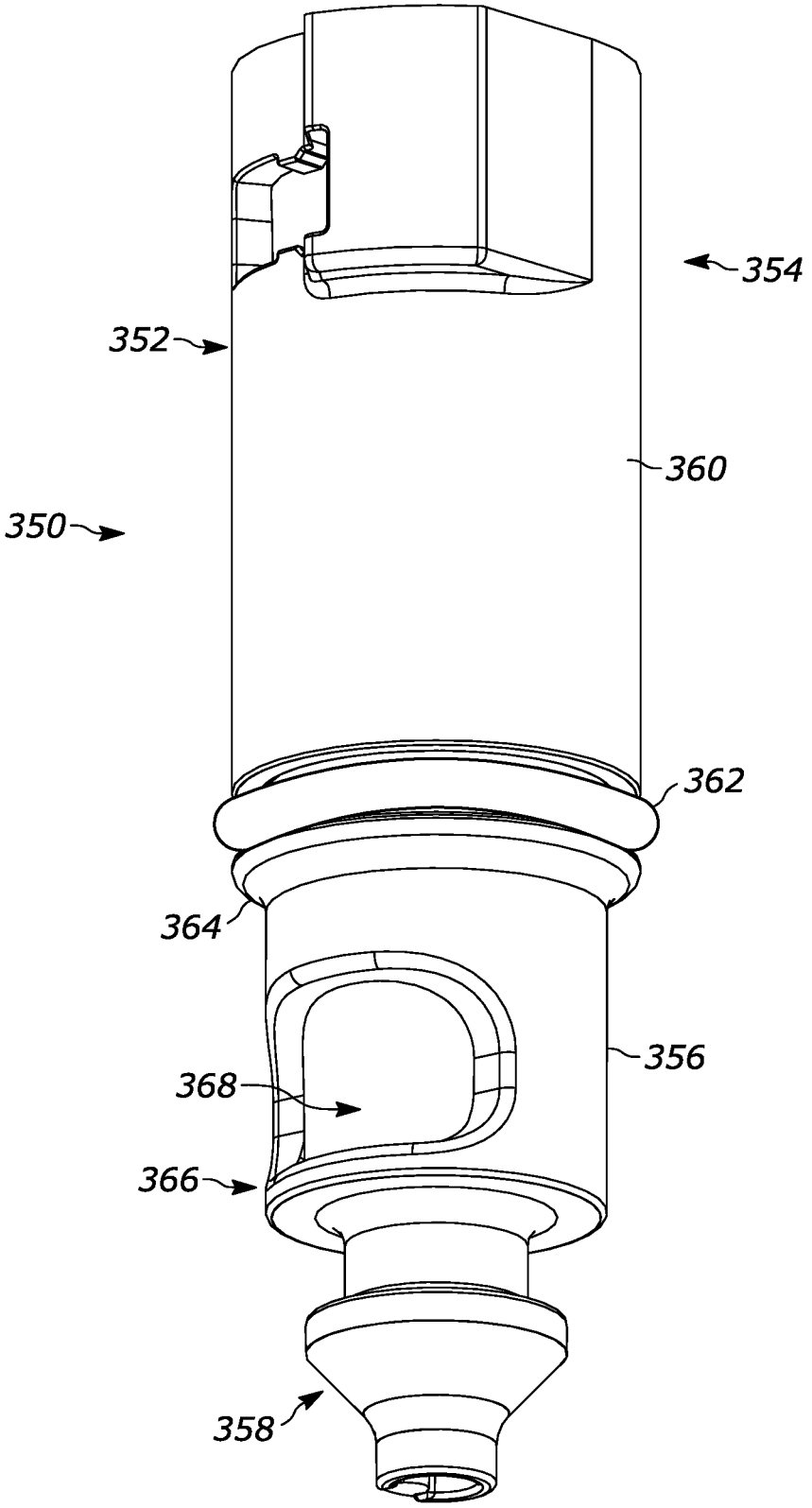
FIG. 21 of the drawings is a perspective view of the probe.
Figure 22:
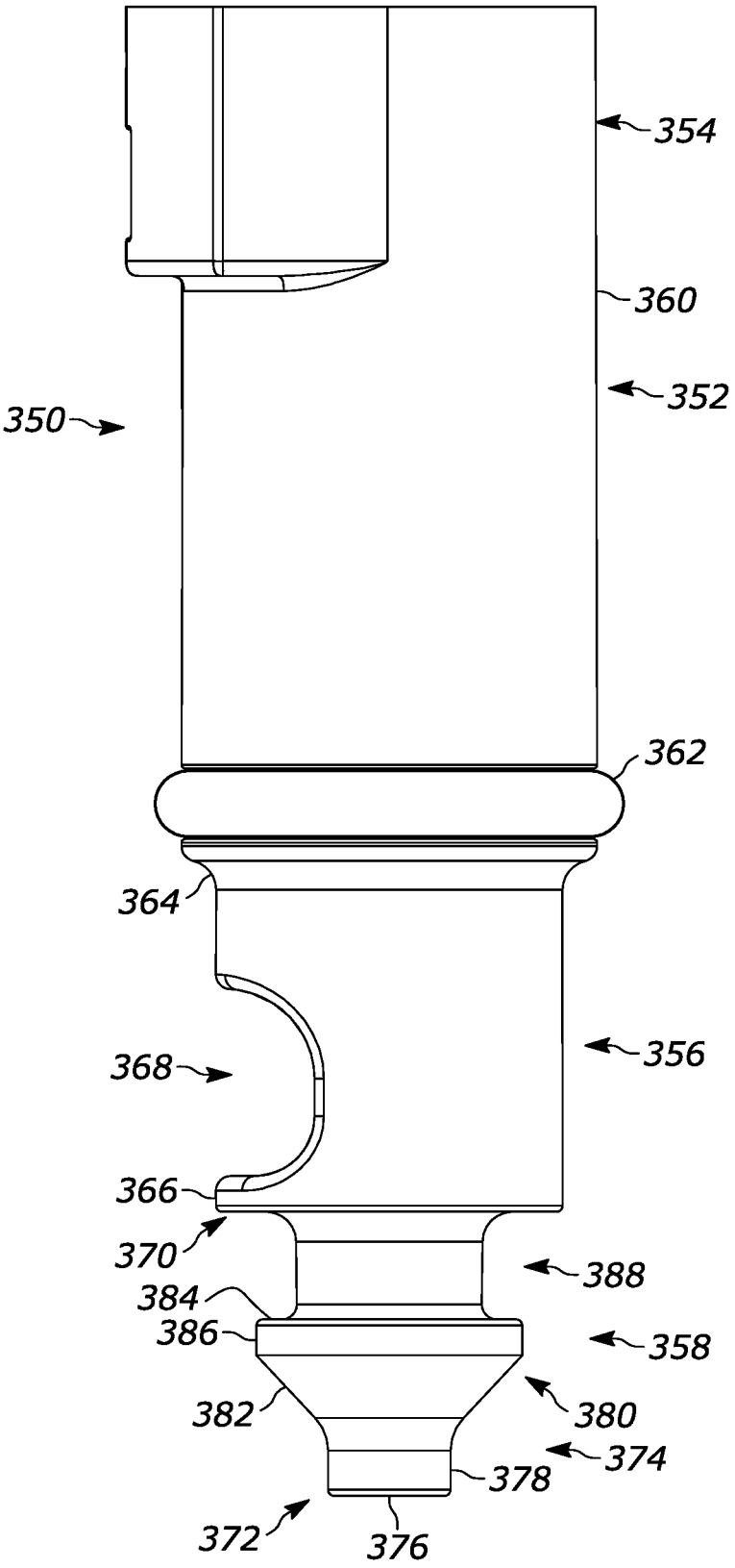
FIG. 22 of the drawings is a side elevational view of the probe.
Figure 23:
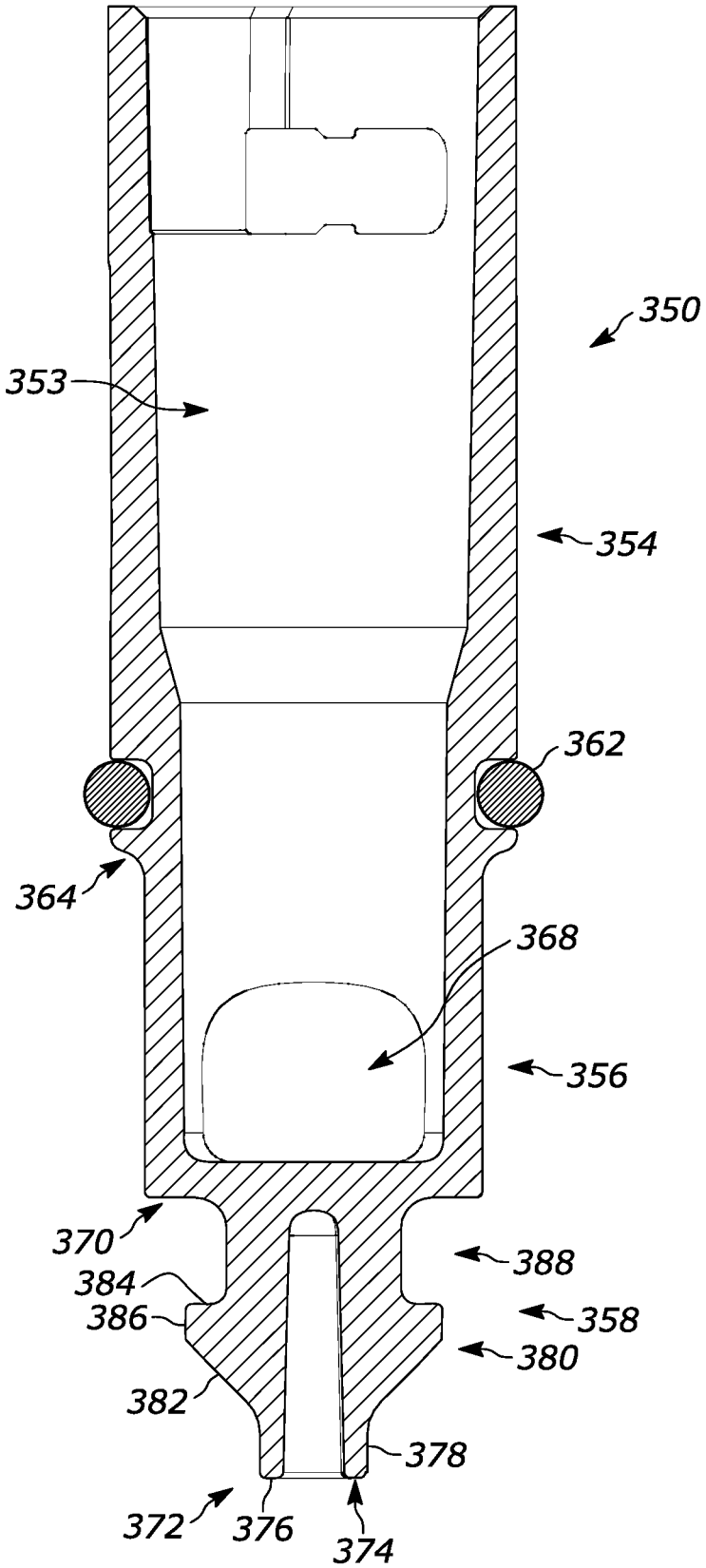
FIG. 23 of the drawings is a cross-sectional view of the probe.
Figure 24:
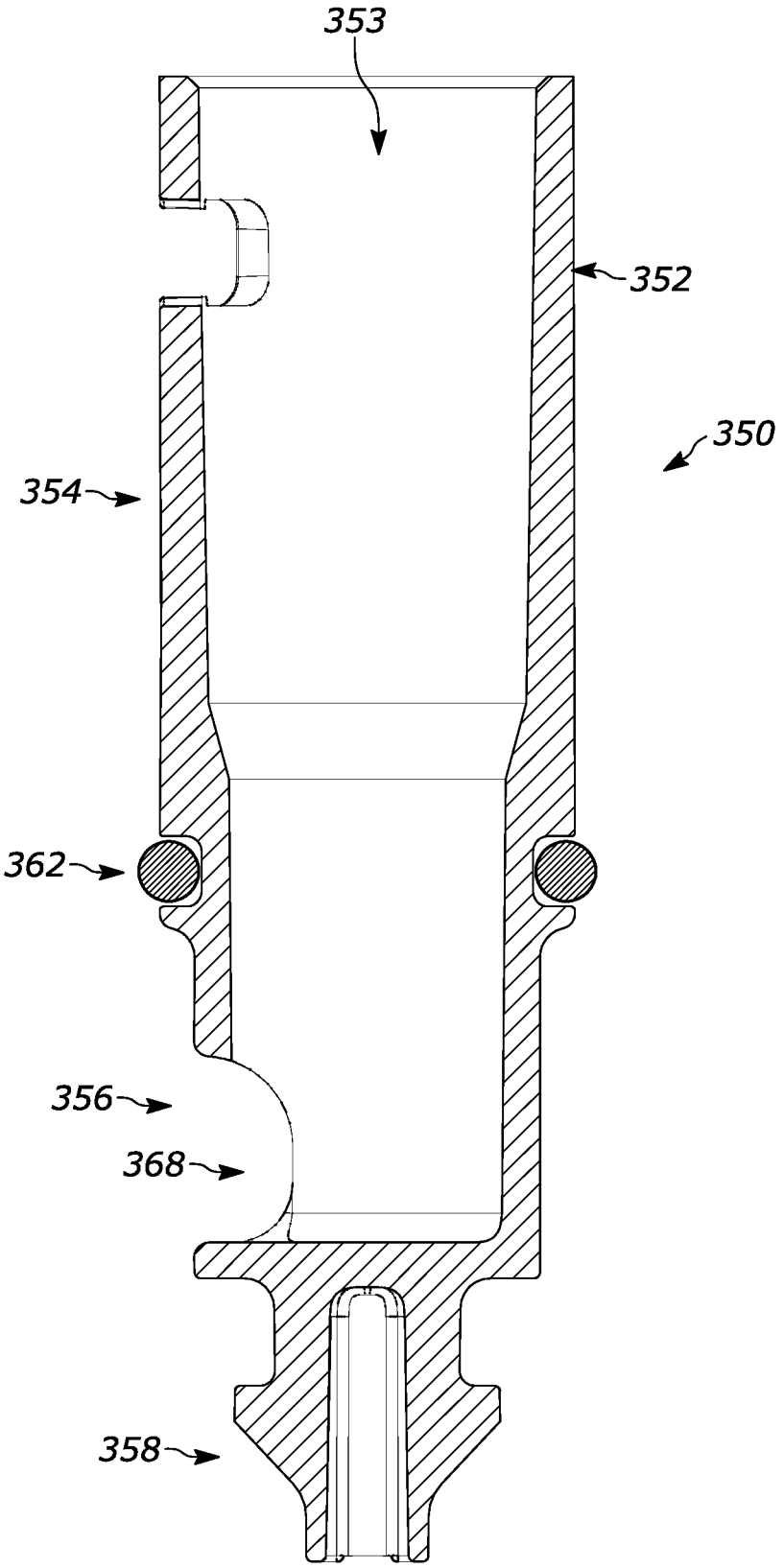
FIG. 24 of the drawings is a second cross-sectional view of the probe taken at a right angle to the view of FIG. 23.
Figure 25:
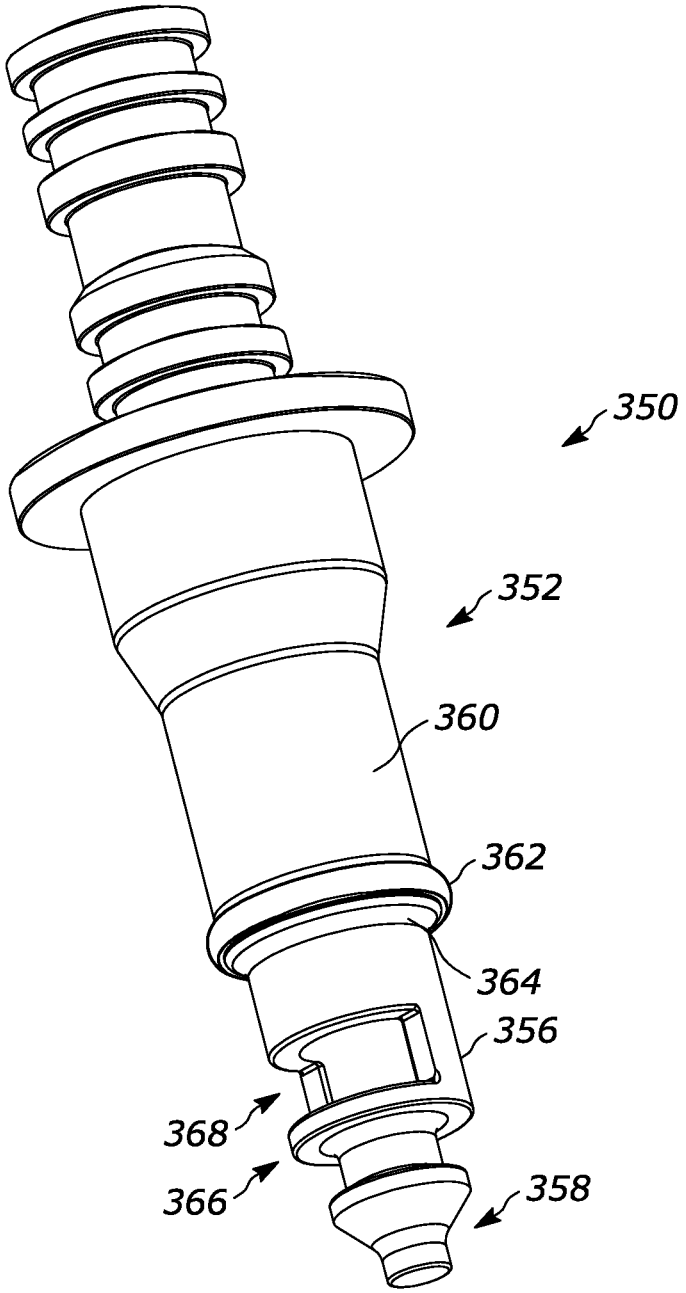
FIG. 25 of the drawings is a perspective view of another probe.

The cap clips 84, 84' are positioned on opposite sides of teach other (i.e., 180° apart) and are generally mirror images of each other about a plane bisecting the plug member in half. The cap clips 84, 84' are offset from the plug clips 82, 82' by 90° so that angularly the four clips are equally spaced about the base of the plug member. The cap clip 84 will be described, with the understanding that the cap clip 84' is substantially identical in structure. The cap clip 84 includes stem 160 and head 166. The stem 160 includes an upper end 162 and a lower end 164, with the lower end meeting upper portion 118 of the plug member 14 (and, preferably, outboard of, or, spaced apart from, the inner face of the channel hoop region). The lower end of the stem 160, 160' of the cap clip is positioned further from the center of the base than the lower end of the stem 130, 130' of the plug clip so that the plug clip is inboard of the cap clip and the cap clip is outboard of the plug clip. The head 166 includes outward tab 170 and inward tab 178. The outward tab 170 includes lower end 172, upper end 174 and central region 176. The lower end of the outward tab 170 is configured to engage with the upper region 70 of the locking bead 68 when the plug member is installed in the dispensing tube. The upper end of the outward tab is configured to engage the lower region of the locking bead to urge the cap clips inwardly and beyond the locking bead during installation. While other configurations are contemplated, the inward tab 178 includes a face 179 is configured to be substantially planar (i.e., defining a generally cylindrical configuration with the opposing inward tab 178' of the opposing cap clip) allow the probe to extend thereacross while directing the head outwardly to further engage the lower end of the outward tab with the upper region of the locking bead 68 of the depending tube, so as to preclude disengagement of the plug from the cap before the plug is fully coupled to the plug member. Preferably, and as shown in FIG. 15*b*, face 179 terminates at a flange 177 that is disposed so as to be perpendicular to the face 179.

The tamper cover 16 is shown as comprising a frangible foil member that can be adhered to the upper surface 20 of the cap member 12. The tamper cover may comprise a multi-layer material defining an upper surface 190 and a lower surface 192 opposite the upper surface 190. A plurality of pull tab outward nubs 196 are disposed about the outer perimeter 195 of the device. In the configuration shown, there are a total of four pull tab outward nubs that extend outwardly from the outer perimeter, and that are disposed uniformly about the outer perimeter.

With general reference to FIGS. 18 through 25, and with particular reference to FIGS. 21 through 24, the probe is shown at 350. The probe 350 includes body 352 defining a probe bore 353. The body includes upper portion 354, neck portion 356 and locking portion 358. The upper portion 354 includes outer surface 360 which includes a seal member 362. The upper portion 354 is configured to fit through an interference fit within the bore 64 of the dispensing tube 24 of the cap member. The seal member 362 may comprise an O-ring or a sealing bead formed into the outer surface to further provide, preferably, a hermetic seal with the inner surface of the dispensing tube. In some configurations, the probe may be of a polymer material, while in others, the probe may be of a metal based member (such as a stainless steel, or the like).

The neck portion 356 includes upper interface ridge 364 and lower end 366. As will be understood, the upper interface ridge 364 abuts the upper region 70 of the locking bead 68 to preclude further insertion of the probe 350 within the dispensing tube. The lower end includes bore opening 368 which allows for fluid communication between the probe bore 353 and the cavity of the flexible bag when the plug member is disconnected from the cap member.

The locking portion 358 is configured to engage the plug member and to maintain coupling with the plug member as the plug member is disconnected and reconnected with the cap member. In particular, the locking portion extends from the neck portion and defining an upper end 370 and a lower end 372. The plug engagement end 374 includes lower surface 376 and outer surface 378. The lower surface and outer surface seats against the central hub region 94 of the base of the plug member.

The clip engagement tab 380 extends about the outer surface of the locking portion 358 and includes lower portion 382, upper flange 384 and central portion 386. The upper flange 384 and the lower end of the neck portion 366 cooperate to form well 388 therebetween. The lower portion 382 of the clip engagement tab 380 is outwardly inclined (forming a conical configuration) and is configured to outwardly direct the clips during insertion of the probe. The central flange maintains the outward direction of the clips as the probe is inserted and the upper flange engages the lower end 152 of the plug clips 82 to maintain the engagement.

Figure 26:
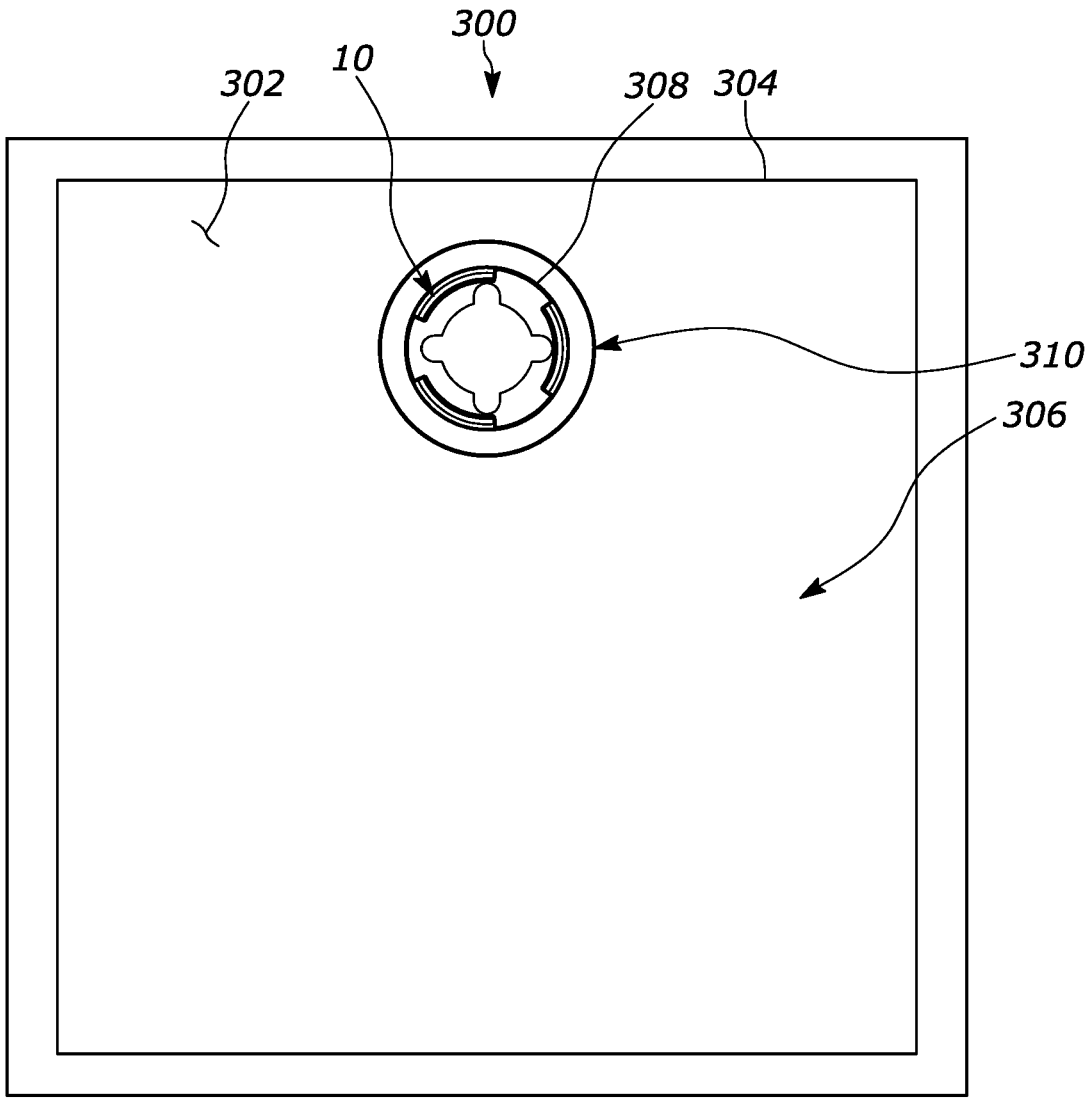
FIG. 26 of the drawings is a flexible bag having a spout forming a flexible container, the flexible container having a fitment assembly coupled thereto.

In operation, the flexible container shown in FIG. 26 is provided, and the flexible bag thereof is filled with a flowable product and a fitment assembly is provided thereon (i.e., coupled thereto, typically after filling). Initially, the plug member 14 is sealingly engaged with the dispensing tube 24 of the cap member, and the cap member is applied to the upstanding member of the spout 310, so as to seal the cavity of the flexible bag.

Additionally, the tamper cover 16 extends over the central opening 36 of the top deck of the cap member 12. In the configuration shown, due to the orientation of the pull tab outward nubs and the spacing thereof about the outer perimeter 195 of the tamper cover 16, and the orientation of the guard nubs 39 on the upper surface 30 of the cap member 12, as well as the spacing thereof about the outer perimeter of the top deck 20, regardless of the orientation of the cap member when the tamper cover is applied, and regardless of the orientation of the tamper cover relative to the cap cover, such spacing results in at least one pull tab outward nub being positioned so as to correspond to the valley between adjacent guard nubs. In such a configuration, a user can easily grasp and pull the pull tab outward nubs without being blocked or otherwise obstructed by the guard nubs.

Once dispensing is desired, the probe 350 is coupled to the fitment assembly 10. Initially, the user peels off the tamper cover 16 so as to expose the central opening 36 for insertion of the probe. In other configuration, the probe may be directed through tamper cover (breaking the frangible surface thereof, and exposing the central opening 36 of the cap member 12). The probe is then directed into the dispensing tube 24 toward the lower end thereof. The seal member 362 and the relative size of the upper portion 354 of the probe 350 places the probe and the dispensing tube in sealed engagement.

Eventually, the locking portion 358 of the probe 350 reaches the plug member 14, initially in a sealed orientation. In particular, the probe 350 makes contact with the plug clips 82, 82' of the plug member (contact can likewise be made with the inward tab 178 of the cap clips 84, 84'). In greater detail, the lower portion 382 of the locking portion 358 of the probe 350 contacts the upper end of the inward tab 148 of the plug clips, pushing the plug clips outwardly. The cap clips can likewise be pushed outwardly. This outward push of the clips, directs the outward tabs of the plug clips and the cap clips into contact with the upper region 70 of the locking bead 68 of the dispensing tube. This locks the plug member relative to the dispensing tube while the insertion of the probe continues. Eventually, the clips are pushed outwardly sufficiently, and the lower portion of the lip engagement tab extends beyond the heads of the clips. The inward tabs of the clips engage the central portion of the clip engagement tab. Once the central portion passes the head of the clips, the clips snap back into their initial unstressed configuration, and the inward tabs can reside within the well 388 defined in the probe. Due to the different temporal engagement of the plug clips and the cap clips with the dispensing tube and the probe, the configuration is such that the inward tabs of the at least two plug clips extend inwardly beyond the inward tabs of the at least two cap clips, and the outward tabs of the at least two cap clips extend outwardly beyond the outward tabs of the at least two plug clips. Such a configuration helps to facilitate the sequential attachment and detachment of the probe and the plug member from each other and also from the dispensing tube.

Continued insertion of the probe pushes against the plug member 14 relative to the cap member. Such downward force of the plug member (due to the probe) results in the upper region 68 of the locking bead directing the outward tabs of the cap clips 84 inwardly into the well 388 sufficiently so as to allow the plug and the clips to pass beyond the locking bead, taking the probe out of a sealed orientation and into an unsealed orientation. Advantageously, while the overall height of the fitment assembly is minimized, it is preferred that the plug makes and breaks the seal with the plug seal bead of lower end of the dispensing tube while the plug remains within the confines of the spout (i.e., the channel formed by the upstanding member), and prior to the passage of the plug beyond the base flange 312 of the spout 310 and beyond the opening of the bag member so as to enter the cavity of the bag. That is, the plug member seal can be broken and or reconnected without the plug extending into the cavity of the bag, and while remaining within the channel of the upstanding member.

Once beyond the locking bead, the plug member can be fully disconnected from the cap member, and, the probe can continue insertion into the dispensing tube until the upper interface ridge 364 of the neck hits the upper region 70 of the dispensing tube, wherein further insertion is precluded, placing the plug in an outermost open orientation (which is an outermost position of the plug member within an unsealed orientation). At such time, the plug extends into the cavity of the of the bag and, preferably, at least a portion of the bore opening 368 is within the cavity of the flexible bag and otherwise in fluid communication with the cavity. The flowable material can be withdrawn from the cavity, through the bore opening 368 and through the probe bore 353.

Once a desired amount of flowable material has been removed, the procedure can be reversed, and the probe can be withdrawn from the dispensing tube. As the probe is being withdrawn, eventually, the upper end 174 of the cap clips 84, 84' is directed inwardly by the lower region 74 of the dispensing tube so that the plug member can be further inserted into the dispensing tube. At the same time, the inward tabs 178 are directed inwardly to engage the upper flange 385 of the probe 350 to preclude disconnecting of the probe from the plug member. Eventually, the plug reaches the end of travel, where the outward tab of the cap clips have extended beyond the locking bead and where the circumferential flange 99 has engaged the lower end 62 of the dispensing tube (with the plug member returning to the confines of the spout member prior to sealed engagement of the plug member with the dispensing tube). Additionally, the sealing region 124 of the outward face 116 of the base sealingly engages the plug sealing bead 69 at the lower end of the dispensing tube completing placement into the sealed orientation.

Further withdrawal of the probe member outwardly directs the probe clips sufficient to allow the locking portion to decouple from the probe clips and the probe can be slidably withdrawn. It will be understood that the movement of the probe relative to the fitment member can be achieved through the movement of the fitment assembly upon a stationary probe, the movement of a probe upon a stationary fitment assembly, and/or upon movement of both the probe and the fitment assembly relative to each other.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

The invention claimed is:

1. A fitment assembly attachable to a spout, the fitment assembly comprising:

a cap member including:

a top deck with an upper surface and a lower surface, a spout coupling member comprising an outer dependent skirt and an inner dependent skirt spaced apart from the outer dependent skirt forming a channel structurally configured to accept the spout in sealed engagement therebetween; and a dispensing tube defining an elongated bore spaced apart from the inner dependent skirt, the dispensing tube defining an upper end proximate the lower surface of the top deck and terminating at a lower end, the dispensing tube further including an inner surface having a locking bead positioned between the upper end and the lower end, and a plug sealing bead proximate between the locking bead and the lower end; and a plug member fully separable from the dispensing tube when in a unsealed orientation, the plug member including:

a base having a central region, and an outward face with a sealing region extending thereabout structurally configured to sealingly engage the plug sealing bead of the dispensing tube;

at least two plug clips positioned opposite each other and extending from the base, each plug clip including a stem and terminating at a head, the head including an inward tab and an outward tab opposite the inward tab; and at least two cap clips positioned opposite each other and extending from the base and spaced apart from the at least two plug clips so as to alternate therewith, each cap clip including a stem terminating at a head, the head including an inward tab and an outward tab, the outward tab structurally configured to releasably engage with the locking bead of the dispensing tube when the plug member is in a sealed orientation;

wherein the inward tabs of the at least two plug clips extend inwardly beyond the inward tabs of the at least two cap clips, and the outward tabs of the at least two cap clips extend outwardly beyond the outward tabs of the at least two plug clips.

2. The fitment assembly of claim 1 further comprising:

a tamper cover removably positionable over the upper surface of the top deck, the tamper cover having an outer perimeter with a plurality of pull tabs outward nubs extending outwardly from the outer perimeter in a spaced apart orientation; and wherein the upper surface of the top deck further includes a plurality of guard nubs extending from the surface and spaced apart from each other at an outer surface of the top deck, the guard nubs defining a valley therebetween; and wherein the spacing between the guard nubs about the top deck and the pull tab outward nubs of the tamper cover, regardless of the orientation of the tamper cover on the top surface, results in at least one pull tab outward nub aligning with a valley between two guard nubs of the plurality of guard nubs.

3. The fitment assembly of claim 2 wherein three guard nubs are uniformly spaced apart from each other about the top deck and four pull tab outward nubs are uniformly spaced apart from each other about the outer perimeter of the tamper cover.

4. The fitment assembly of claim 1 wherein a channel hoop region extends about the central region, with the outer face forming a portion of the central region, and further defining a channel between the outer face and the central region, the channel providing flexibility so that upon sealed engagement with the plug sealing bead of the dispensing tube, the ring region is outwardly biased against the plug sealing bead.

5. The fitment assembly of claim 4 wherein a circumferential flange extends about a lower end of the outward face and is configured to interface with the lower end of the dispensing tube when the plug member is in the sealed orientation.

6. The fitment assembly of claim 5 wherein the circumferential flange and the central region of the base being substantially coplanar and define a lower surface of the plug member.

7. The fitment assembly of claim 6 wherein the circumferential flange and the outward face are substantially perpendicular to each other.

8. The fitment assembly of claim 4 wherein the central region further includes a ring region outboard thereof and inboard of the channel hoop region, the channel hoop region having an inner face extending from an upper surface of the ring region, with the central region, the upper surface and the inner face together cooperating to form a cavity structurally configured to receive a lower end of a probe, the inner face and the upper surface of the ring region being substantially perpendicular to each other.

9. The fitment assembly of claim 8 wherein the stems of each of the at least two plug clips and the stems of each of the at least two cap clips are spaced apart from the inner face of the channel hoop region.

10. The fitment assembly of claim 9 wherein the stems of each of the at least two plug clips and the stems of each of the at least two cap clips are spaced apart from the outward face.

11. The fitment assembly of claim 1 wherein the stems of the at least two plug clips are inboard of the stems of the at least two cap clips.

12. The fitment assembly of claim 1 wherein the locking bead and the plug sealing bead are spaced apart from each other along the inner surface of the dispensing tube.

13. The fitment assembly of claim 1 wherein the plug sealing bead is spaced apart from the lower end of the dispensing tube.

14. The fitment assembly of claim 1 wherein the inward tab of each of the at least two cap clips define a face such that the two opposing faces of the inward tabs of the at least two cap clips define a cylindrical configuration.

15. The fitment assembly of claim 14 wherein the inward tab of each of the at least two cap clips terminate at a lower end with a flange, wherein the flange is perpendicular to the face.

16. A flexible container comprising:

a flexible bag having a plurality of panels having a plurality of seals to define a cavity, and with an opening providing communication with the cavity;

a spout having a base flange and an upstanding member extending from the base flange terminating at an upper edge, the base flange is coupled to the bag about the opening in fluid tight engagement the upstanding member defining a channel that is in fluid communication with the cavity; and the fitment assembly of claim 1, wherein the upstanding member extends into the channel formed by the inner dependent skirt and the outer dependent skirt and is in sealed engagement therein.

17. The flexible container of claim 16 wherein the dispensing tube and plug member are structurally configured so that the plug member can go between a sealed orientation and an unsealed orientation while the plug member remains within the channel of the upstanding member.

18. A probe configured for use in association with a flexible container, the probe comprising a body including:

an outer surface and an inner bore, the probe structurally configured to be insertable into a dispensing tube of a cap member;

a locking portion disposed at a lower end of the body;

a seal member disposed about the outer surface spaced apart from the locking portion, the seal configured for sealing engagement between the dispensing tube and the body of the probe;

a probe bore extending therethrough and terminating at a bore opening through the outer surface, the bore opening defined between the locking portion and the seal member;

an upper interfacing ridge positioned between an upper portion and the locking portion, the upper interfacing ridge configured to engage the locking bead to preclude further insertion of the probe into the dispensing tube;

the locking portion structurally configured to engage a plurality of plug clips of a plug member so as to releasably engage therewith, wherein the probe is configured to direct the plug member between the sealed orientation and the unsealed orientation, separated from the dispensing tube, while being releasably coupled thereto.

19. A method of dispensing comprising the steps of:

providing the flexible container of claim 16;

providing a probe, the probe comprising a body including:

an outer surface and an inner bore, the probe structurally configured to be insertable into the dispensing tube of the cap member;

a locking portion disposed at a lower end of the body;

a seal member disposed about the outer surface spaced apart from the locking portion, the seal configured for sealing engagement between the dispensing tube and the body of the probe;

a probe bore extending therethrough and terminating at a bore opening through the outer surface, the bore opening defined between the locking portion and the seal;

an upper interfacing ridge positioned between an upper portion and the locking portion, the upper interfacing ridge configured to engage the locking bead to preclude further insertion of the probe into the dispensing tube;

the locking portion structurally configured to engage the plug clips of the plug member so as to releasably engage therewith, wherein the probe is configured to direct the plug member between the sealed orientation and the unsealed orientation, while being releasably coupled thereto;

directing a probe into the dispensing tube;

forming a seal between the dispensing tube and outer surface of the probe;

releasably engaging the plug member with the locking portion of the probe;

directing the probe inwardly to direct the plug member from a sealed orientation to an unsealed orientation, separated from the dispensing tube; and withdrawing flowable material from within the cavity of the flexible bag through the probe.

20. The method of claim 19 wherein the step of directing the probe inwardly to direct the plug member from a sealed orientation to an unsealed orientation can occur while maintaining the probe within the channel of the spout.

* * * * *